US009587903B2

(12) United States Patent
Sullivan et al.

(10) Patent No.: US 9,587,903 B2
(45) Date of Patent: Mar. 7, 2017

(54) PNEUMATIC LAUNCHER SYSTEM AND METHOD

(71) Applicants: Brian E. Sullivan, Alta Loma, CA (US); Benjamin T. Tiberius, Fort Wayne, IN (US)

(72) Inventors: Brian E. Sullivan, Alta Loma, CA (US); Benjamin T. Tiberius, Fort Wayne, IN (US)

( * ) Notice: Subject to any disclaimer, the term of this patent is extended or adjusted under 35 U.S.C. 154(b) by 0 days.

(21) Appl. No.: 14/630,640

(22) Filed: Feb. 24, 2015

(65) Prior Publication Data

US 2016/0076850 A1 Mar. 17, 2016

Related U.S. Application Data

(60) Provisional application No. 61/944,568, filed on Feb. 25, 2014, provisional application No. 61/944,057, filed on Feb. 24, 2014.

(51) Int. Cl.

| | |
|---|---|
| ***F41B 11/70*** | (2013.01) |
| ***F41A 19/10*** | (2006.01) |
| ***F41A 19/12*** | (2006.01) |
| ***F41A 9/71*** | (2006.01) |
| ***F41A 11/02*** | (2006.01) |
| ***F41A 19/15*** | (2006.01) |
| ***F41B 11/55*** | (2013.01) |

(52) U.S. Cl.

CPC ..... *F41B 11/70* (2013.01); *F41A 9/71* (2013.01); *F41A 11/02* (2013.01); *F41A 19/10* (2013.01); *F41A 19/12* (2013.01); *F41A 19/15* (2013.01); *F41B 11/55* (2013.01)

(58) Field of Classification Search

CPC F41B 11/00; F41B 11/50; F41B 11/52; F41B 11/70; F41B 11/71; F41B 11/73; F41B 11/60

USPC ..... 124/71–77

See application file for complete search history.

(56) References Cited

U.S. PATENT DOCUMENTS

| | | | | |
|---|---|---|---|---|
| 5,771,875 | A * | 6/1998 | Sullivan | F41B 11/721 124/72 |
| 5,987,797 | A | 11/1999 | Dustin | |
| 6,513,274 | B1 | 2/2003 | Vastag | |
| 6,637,420 | B2 | 10/2003 | Moritz | |
| 7,302,881 | B1 | 12/2007 | Tertin | |
| 7,562,478 | B1 | 7/2009 | Vastag | |
| 7,735,409 | B1 | 6/2010 | Tertin | |

(Continued)

*Primary Examiner* — Jonathan C Weber

(74) *Attorney, Agent, or Firm* — Kirk A. Buhler; Buhler & Associates

(57) ABSTRACT

Improvements in a projectile launcher is disclosed. The launcher converts an airsoft gun to fire paintballs to handle feeding either airsoft projectiles or paintball projectiles depending upon the installed kit. The launcher includes a hydraulic damper allows the fire and reload to operate in a controlled motion that allows a projectile to be fires and the next projectile to the loaded in a rapid succession. An improved magazine allows multiple different types of projectiles to be installed in the magazine. An interchangeable trigger mechanism and interchangeable barrel to launch different diameters of projectiles. Different types of firing mechanisms can be removed and interchanged in the launcher. In addition to the barrel can also be changes as the projectile is changed.

20 Claims, 17 Drawing Sheets

(56) References Cited

U.S. PATENT DOCUMENTS

| | | | | |
|---|---|---|---|---|
| 7,861,702 | B1 * | 1/2011 | Sze | F41B 11/56 124/73 |
| 2006/0180134 | A1 * | 8/2006 | Illuzzi | F41A 9/24 124/74 |
| 2007/0017497 | A1 * | 1/2007 | Masse | F41B 11/62 124/73 |
| 2007/0089723 | A1 * | 4/2007 | Mott | F41A 9/01 124/45 |
| 2010/0059032 | A1 | 3/2010 | Zadra | |
| 2010/0282229 | A1 * | 11/2010 | Tran | F41A 9/38 124/71 |
| 2015/0007804 | A1 * | 1/2015 | Tippmann, Jr. | F41B 11/722 124/73 |
| 2016/0047621 | A1 * | 2/2016 | Sullivan | F41B 11/721 124/73 |

* cited by examiner

PNEUMATIC LAUNCHER SYSTEM AND METHOD

CROSS REFERENCE TO RELATED APPLICATION

This application claims the benefit of Provisional Application Ser. No. 61/944,568 filed Feb. 25, 2014 and to Provisional Application Ser. No. 61/944,057 filed Feb. 24, 2014 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in pneumatic launchers and, more particularly, to novel systems and methods for pneumatically launching paintballs, pellets, metal BBs, airsoft BBs, or other projectiles.

Description of Related Art Including Information Disclosed Under 37 CFR 1.97 and 1.98

Conventional firearms have a firing mechanism to fire a projectile and a barrel to direct the projectile in a desired direction. Guns are made for numerous purposes and include many designs, for example, rifles, shot guns, and hand guns. A broad array of different mechanisms for firing a projectile have been employed for various types of guns. For example, one type of gun is dependent on having a propellant combined with the projectile. In this type of gun, the firing mechanism detonates the propellant contained in the projectile, which launches the projectile along the barrel. This type includes shot guns, which fire cartridges comprised of shot packaged with explosive material, and conventional rifles, machine guns, and handguns, which shoot bullets comprised of a unitary slug packaged with explosive material in a casing.

Another method of firing a projectile uses a propulsion source separate from the projectile, such as compressed gas, including air, carbon dioxide, nitrogen, and others. Examples of such guns include, air riffles, BB guns, and paintball guns or "markers." These guns either include a pump for compressing ambient air or are adapted to receive compressed air from a source, such as a compressed gas cartridge or gas cylinder. Conventional paintball guns rely on such cartridges or gas cylinders for supplying compressed gas, including air, nitrogen and carbon dioxide.

A typical firearm is constructed to fire either airsoft projectiles or paintballs. Due to the different handling requirements for the different projectiles for airsoft and paintball guns a conversion kit for handling both of these types of projectiles does not exist. A number of patents have been made to address a gunpowder fired projectiles where the bullet or shotgun handling addresses these issues. Exemplary examples of patents that try to address this/these problem(s) are identified and discussed below.

U.S. Pat. No. 6,513,274 issued on Feb. 4, 2003 to Laszlo Vastag discloses a Removable System for Converting a Breach Loading Shotgun to a .22 Long Rifle. While this patent discloses changing the gun for different types of ammunition, the conversion only allows for firing a single projectile at a time and a user must individually load each bullet into the firearm.

U.S. Pat. Nos. 7,302,881, and 7,735,409 issued on Dec. 4, 2007 and Jun. 15, 2010 respectively, both to James A. Tertin disclose a Conversion Kit and Method for a Ruger 10/22 Semi-Automatic .22 Caliber Rim Fire Rifle to Shoot .17 Mach 2 Cartridges. Both these patents disclose firing bullets where the gun power is present in the cartridge. While the conversion allows the firearm to reload a projectile the gun powder in each bullet provides the forces to eject the fired shell and load another bullet.

U.S. Pat. No. 7,562,478 issued on Jul. 21, 2009 to Laszlo Vastag discloses a Firearm Conversion System and Caliber Reducer with Hammer Safety Lock. This system is for a revolver and includes a caliber reducer that is placed into the barrel of the firearm and the rotatable cylinder is replaced to accept the smaller caliber bullet. While this system allows for the firearm to fire different caliber projectiles, gun power is still the driving mechanism for the projectile and new projectiles are not self-loaded into the firearm.

U.S. Publication Number 2010/0059032 published on Mar. 11, 2010 to Lawrence J. Zadra discloses an Interchangeable Gun Barrel Apparatus and Method. In this publication the existing barrel of the firearm is removed and a completely new barrel is installed onto the firearm.

What is needed is a pneumatic launcher system and method that is configurable as an airsoft firearm that uses compressed gas for expelling a projectile and for loading new projectiles, and further includes a conversion kit to allow the firearm to also fire and reload paintballs using the same compressed gas. The disclosure found in this document provides a solution.

BRIEF SUMMARY OF THE INVENTION

It is an object of the pneumatic launcher system and method to convert an airsoft gun to fire paintballs to feed and fire airsoft projectiles. The airsoft market is much larger than the paintball market, and often a person who uses a paintball gun may also use an airsoft gun. For these people purchasing two different guns for the different activities can be expensive. This is especially true when the user purchases high quality guns. In addition to the expense, a person becomes accustom the characteristics of a particular firearm and switching guns can alter the aim and feel from the perspective of the user.

It is an object of the pneumatic launcher system and method to convert an airsoft gun to fire paintballs to fire paintballs. The activity of combat with paintball guns has grown in great popularity. The accuracy of a paintball gun is critical for marking an opponent. The firing of paintballs can be with firing individual paintballs, a burst of successive paintballs in rapid fire. This burst is typically about three paintballs of rapid fire as paintballs are sprayed in a general area of an opponent. The paintball guns provide a realistic appearance and weight of the paintball gun to simulate an actual combat firearm such as an AR-15 type rifle.

It is another object of the pneumatic launcher system and method to convert an airsoft gun to fire paintballs to handle feeding either airsoft projectiles or paintball projectiles depending upon the installed kit. The kit allows for a user to purchase a single reliable gun that can be used for either activity and then install or remove a kit that allows the gun to be used in either of the two activities.

It is another object of the pneumatic launcher system and method to include a hydraulic damper. The hydraulic damper allows the fire and reload to operate in a controlled motion that allows a projectile to be fires and the next projectile to the loaded in a rapid succession. The hydraulic damper can also be adjusted to calibrate the firing rate of the firearm.

It is another object of the pneumatic launcher system and method to provide an improved magazine. The improved magazine allows multiple different types of projectiles to be installed in the magazine. The projectiles are loaded into the magazine and are pushed with a spring around and oriented out the end of the magazine where they are fed into a firearm. A keeper prevents projectiles from falling out the end of the magazine when the magazine is not filly inserted into the firearm.

It is another object of the pneumatic launcher system and method to provide an interchangeable trigger mechanism and interchangeable barrel to launch different diameters of projectiles. Different types of firing mechanisms can be removed and interchanged in the launcher. This allows the launcher to be upgraded for the firing type, firing rate and projectile types and sizes. In addition to the barrel can also be changes as the projectile is changed.

It is still another object of the pneumatic launcher system and method to convert an airsoft gun to fire paintballs. The conversion requires little or no tools and can be performed in the field as the user prepares for their next combat. While it is unlikely that a user will utilize both airsoft projectiles and paintballs at the same time, a user may use the different types of projectiles in a single day as they switch between the two activities.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

Figure 26:
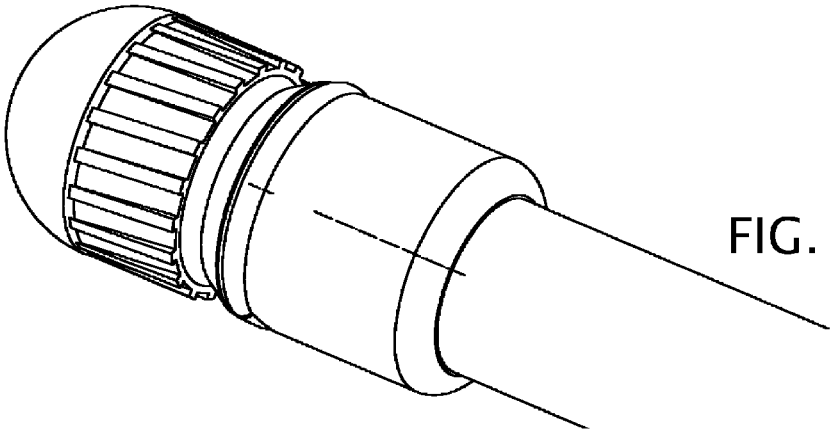

FIG. 26 a perspective view of a projectile seat in the end of the barrel.

Figure 27:
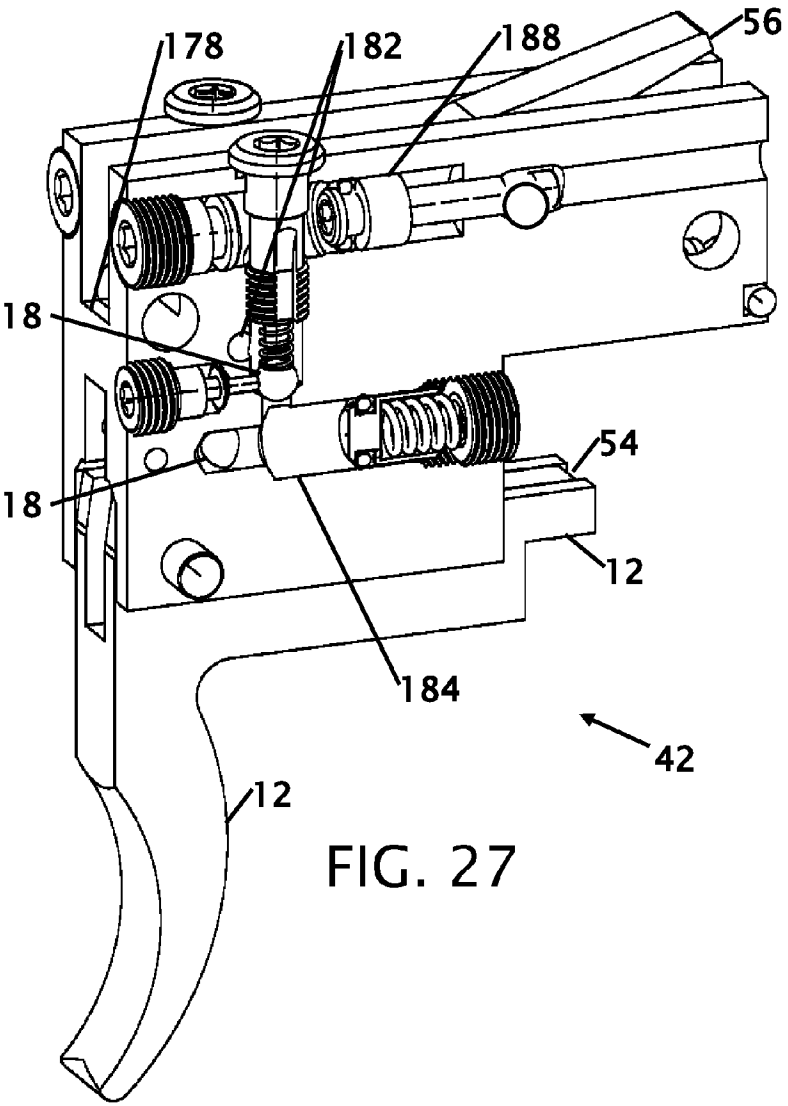

FIG. 27 shows a perspective view of the trigger assembly.

Figure 28:
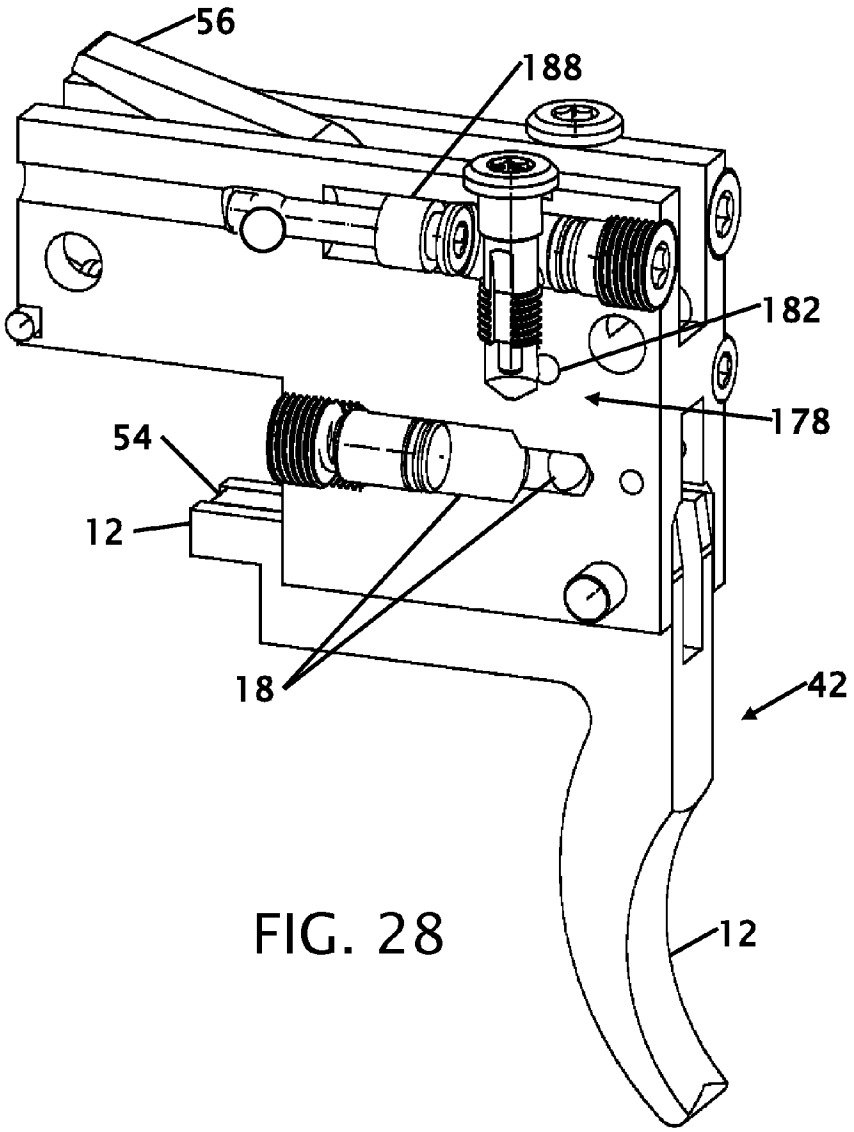

FIG. 28 shows a perspective view of the trigger assembly.

Figure 29:
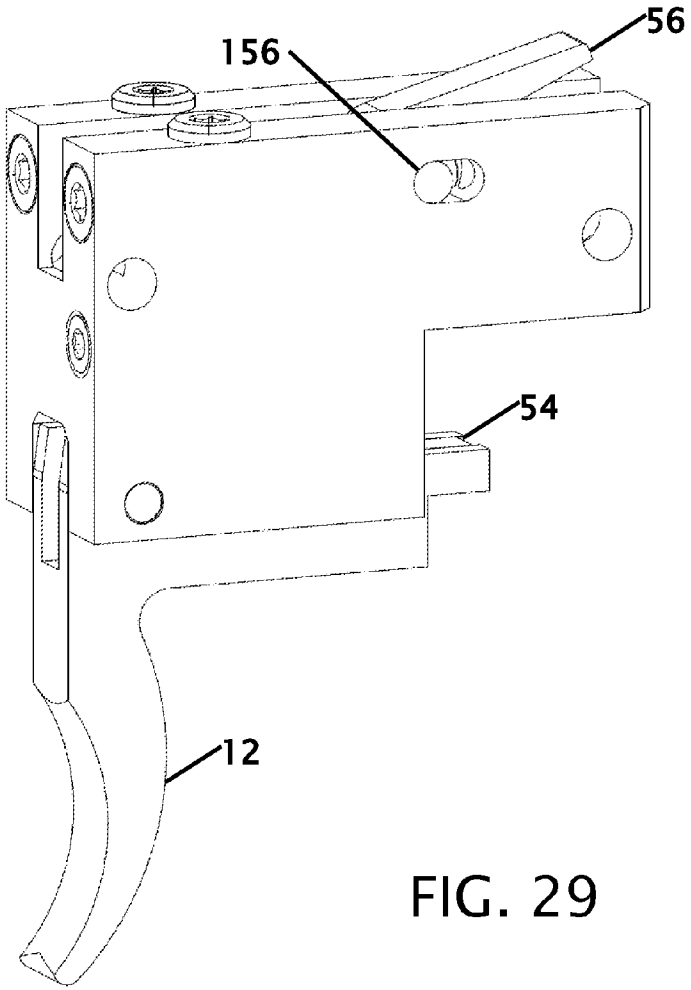

FIG. 29 shows a perspective view of the trigger assembly.

Figure 30:
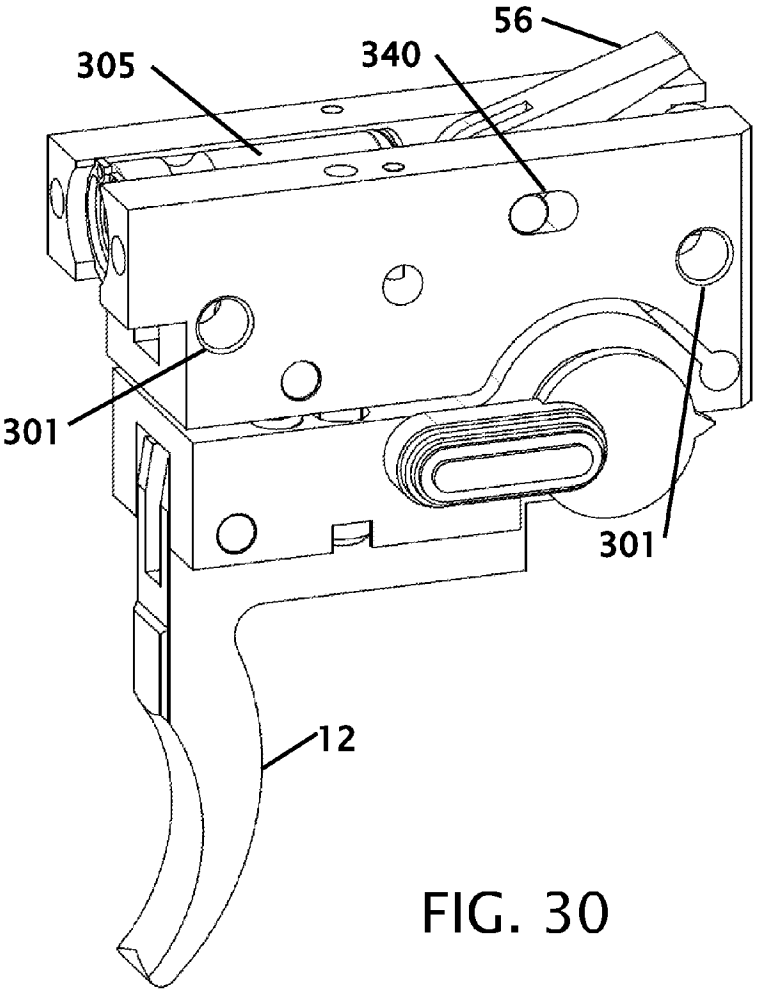

FIG. 30 shows an outer view of the full auto hydraulic module.

Figure 31:
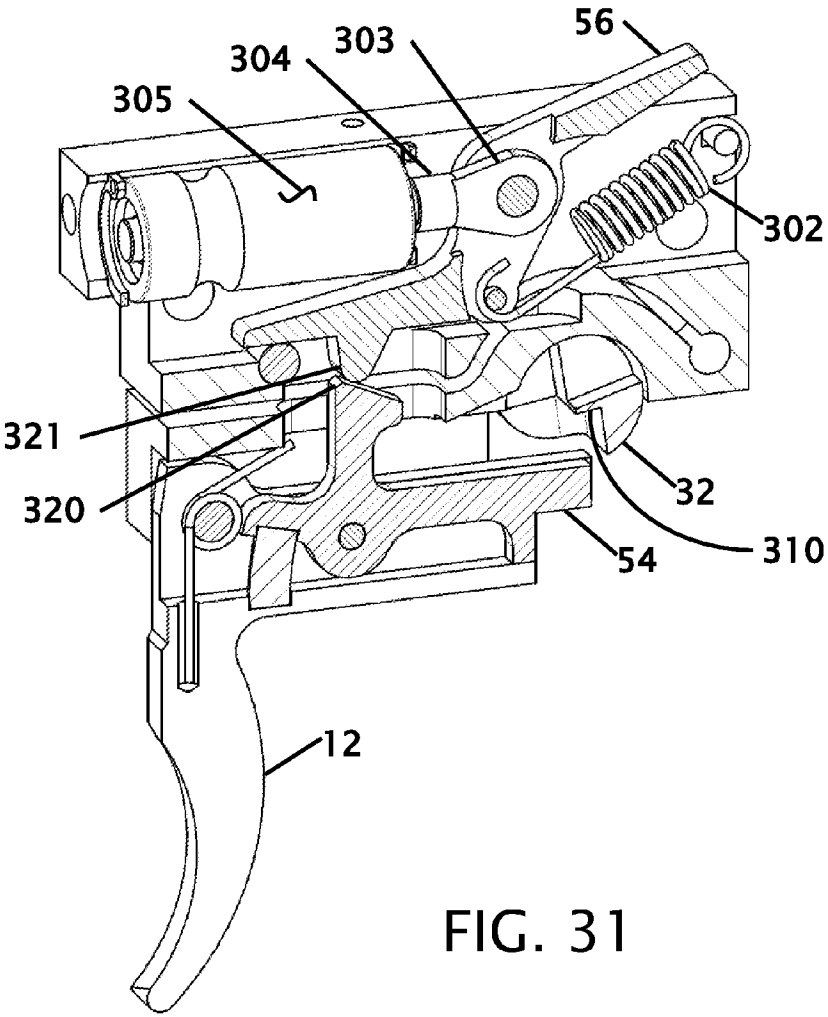

FIG. 31 shows the center section of the full auto hydraulic module.

Figure 32:
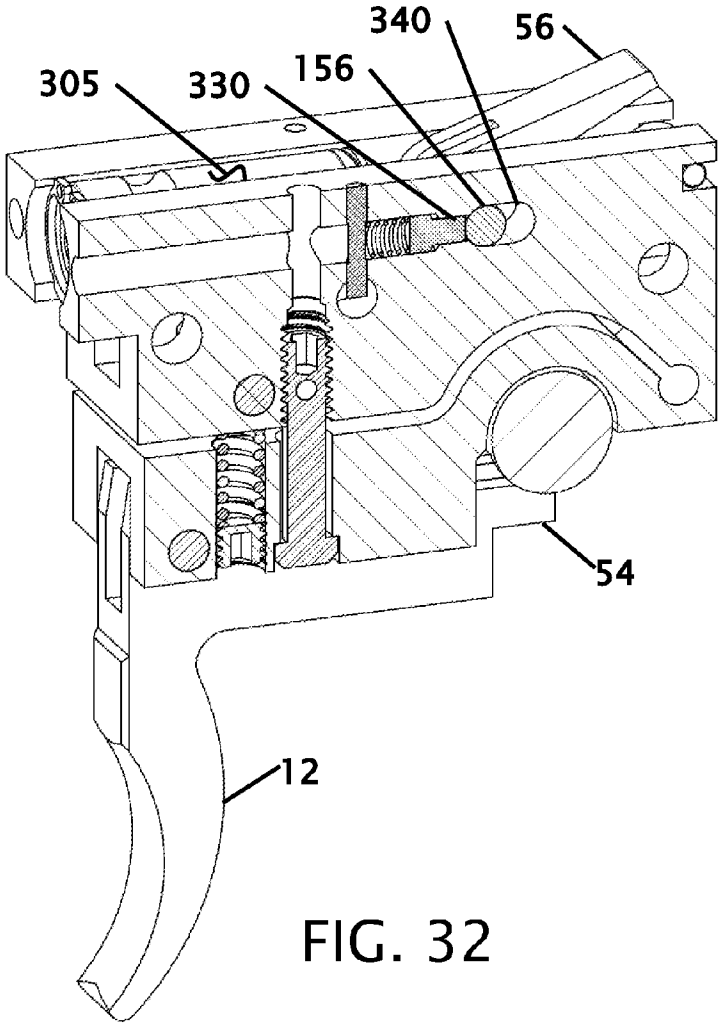

FIG. 32 shows the end stroke preload dampers sectional view full auto hydraulic module.

DETAILED DESCRIPTION OF THE INVENTION

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

Figure 1:
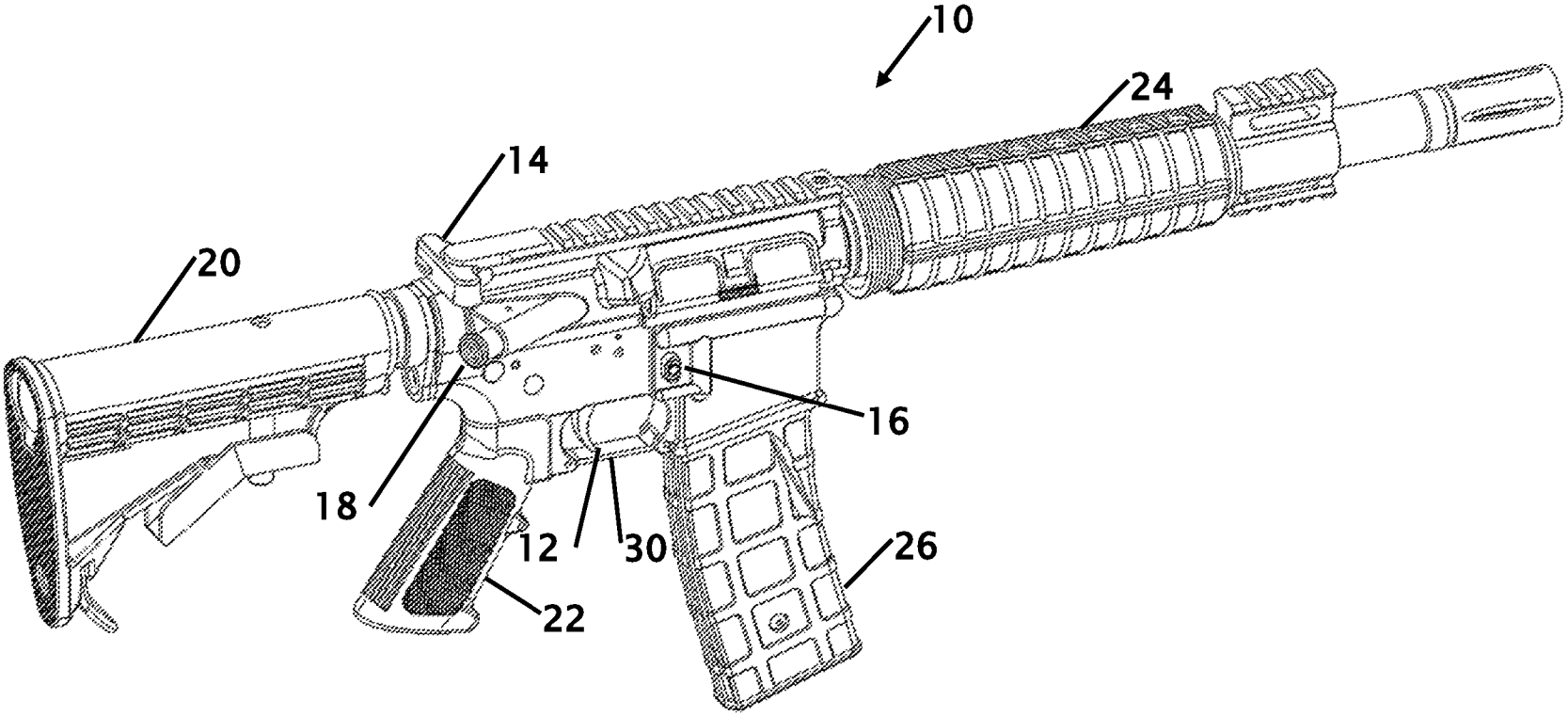
FIG. 1 shows a perspective view of the exterior of a launcher.
Figure 2:
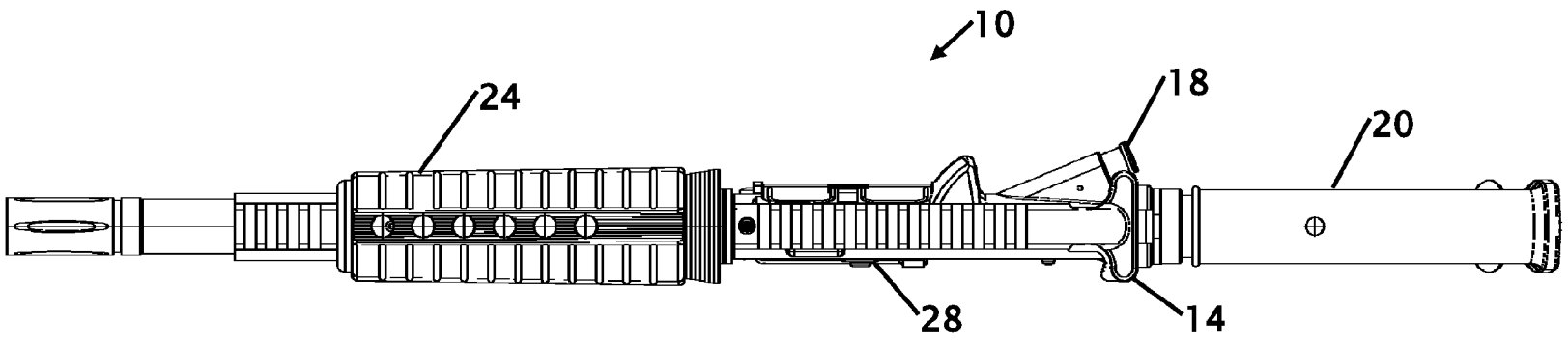
FIG. 2 shows a top plan view of the exterior of the launcher.
Figure 3:
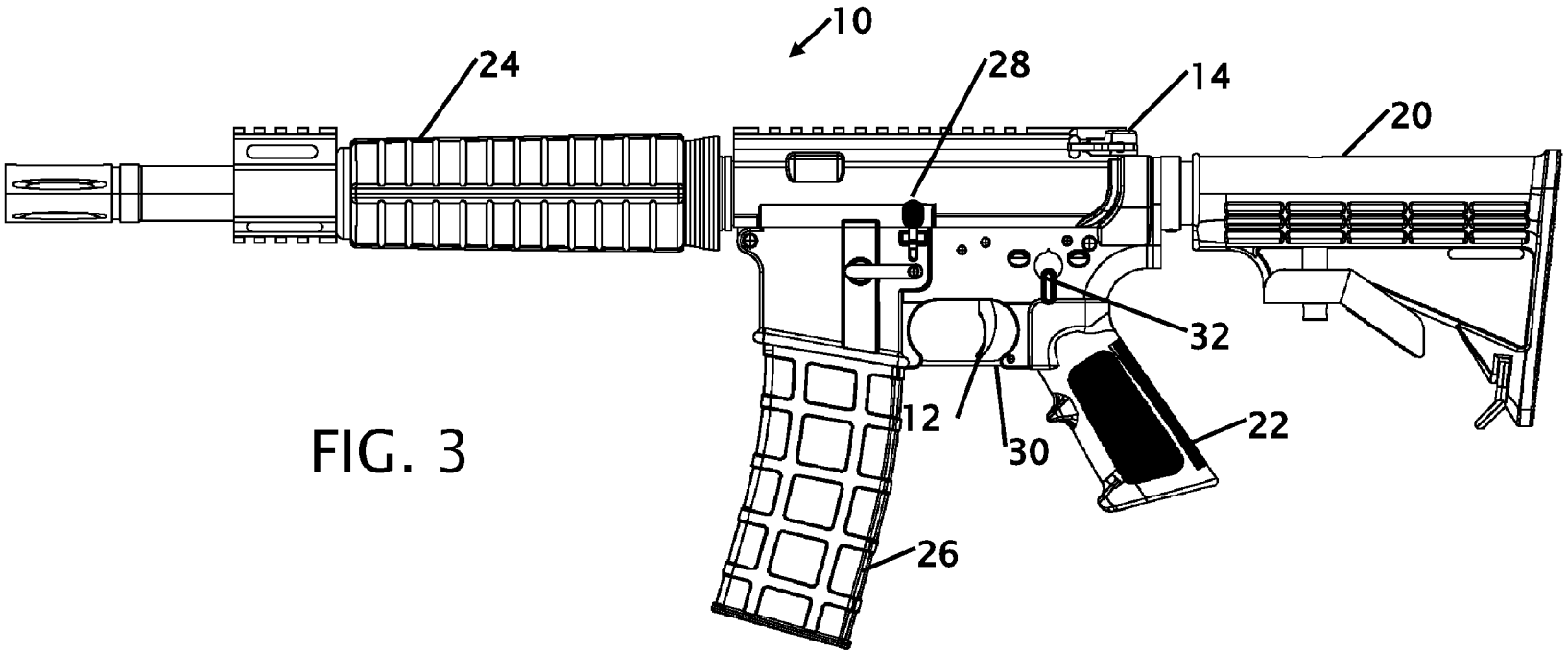
FIG. 3 shows a side plan view of the exterior of the launcher.

Referring to FIGS. 1-3, a launcher 10 in accordance with the present invention may support pneumatic actuation of one or more components thereof. For example, a launcher 10 may support pneumatic actuation or manipulation of an action thereof. Alternatively, or in addition thereto, pneumatic forces may be responsible for propelling a projecting out of a launcher 10.

In selected embodiments, a launcher 10 may have an exterior look and feel that mimics, substantially matches, or matches the look and feel of a particular firearm (e.g., rifle, pistol, or the like). For example, as shown in FIG. 1, a launcher 10 may match or substantially match the exterior dimensions, look and feel, or the like of an AR-15 type rifle. A launcher 10 may also have external controls that match or substantially match the exterior controls of an AR-15 type rifle. Accordingly, a launcher 10 may provide an effective simulation or training platform.

For example, a launcher 10 may include a trigger 12, charging handle 14, magazine release 16, forward assist 18, butt stock 20 (e.g., adjustable butt stock), grip 22, fore grip 24, magazine 26, bolt release 28, trigger guard 30, selector switch 32, or the like or a combination or sub-combination thereof that collectively or individually match or substantially match the operations, sizes, shapes, and/or relative positions of comparable components on an AR-15 type rifle. In certain embodiments, all such components may be functional. In other embodiments, certain components (e.g., a forward assist 18 and/or bolt release 28) may be provided merely to maintain aesthetic realism, but may otherwise be non-functional.

In certain embodiments, various components of a launcher 10 in accordance with the present invention may be actual AR-15 parts. For example, in selected embodiments, a butt stock 20, grip 22, fore grip 24, trigger guard 30, or the like or a combination or sub-combination thereof may be actual AR-15 parts (e.g., "milspec" parts, aftermarket parts, or the like). Accordingly, a user may customize his or her launcher 10 in the same manner and/or with the same parts as he or she would with an actual AR-15 type rifle.

Figure 4:
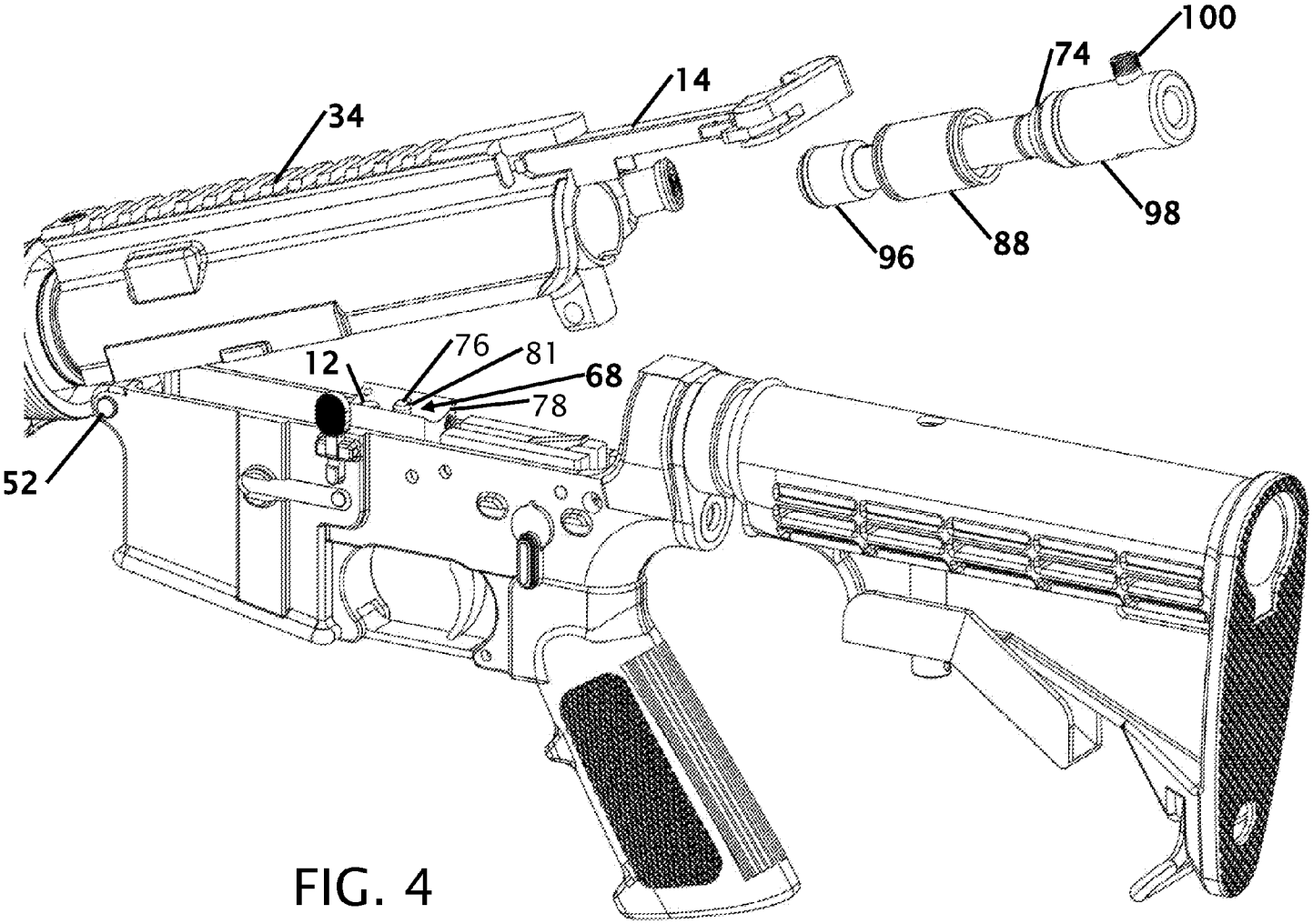
FIG. 4 shows a perspective view of the launcher in an open configuration.
Figure 5:
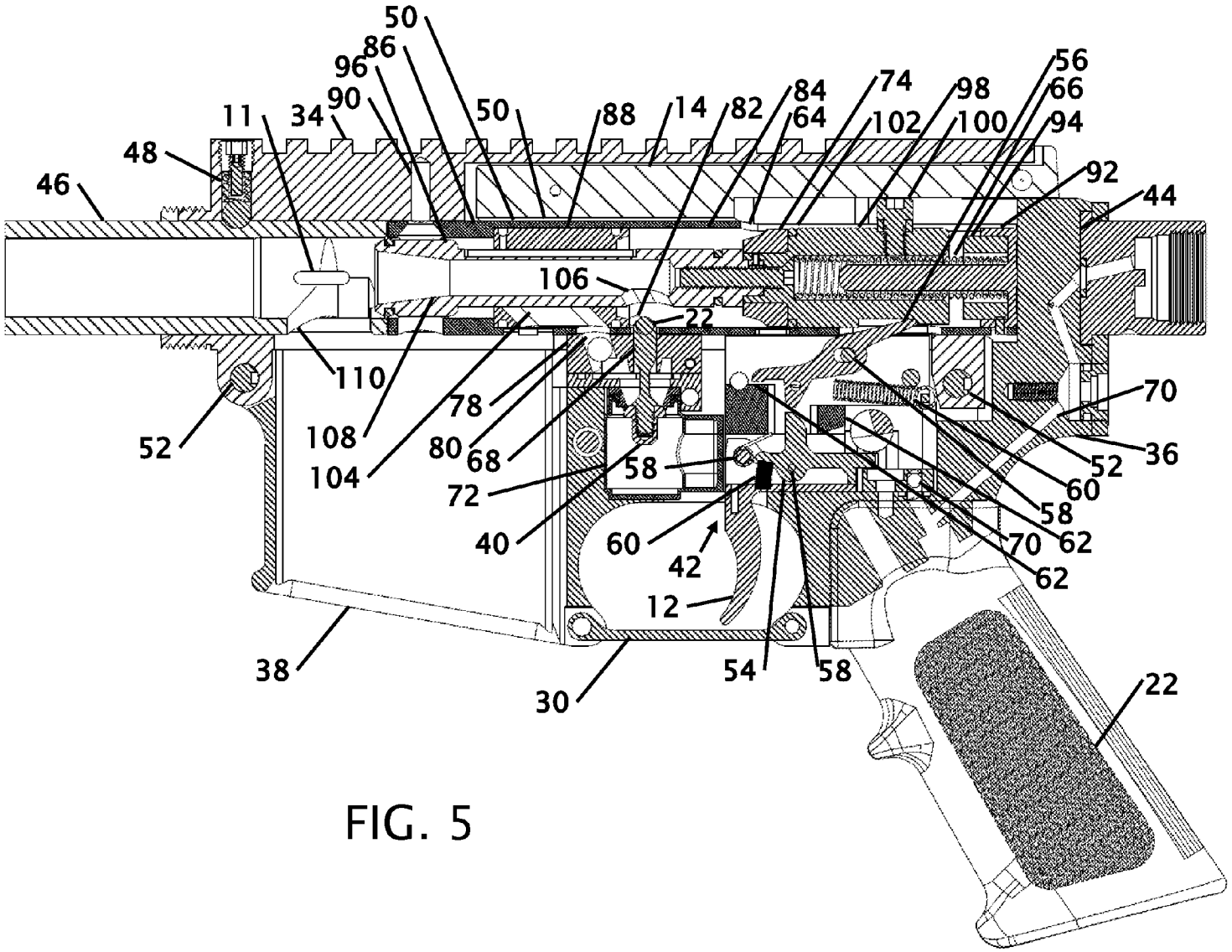
FIG. 5 shows a sectional view of the launcher with the internal components.
Figure 6:
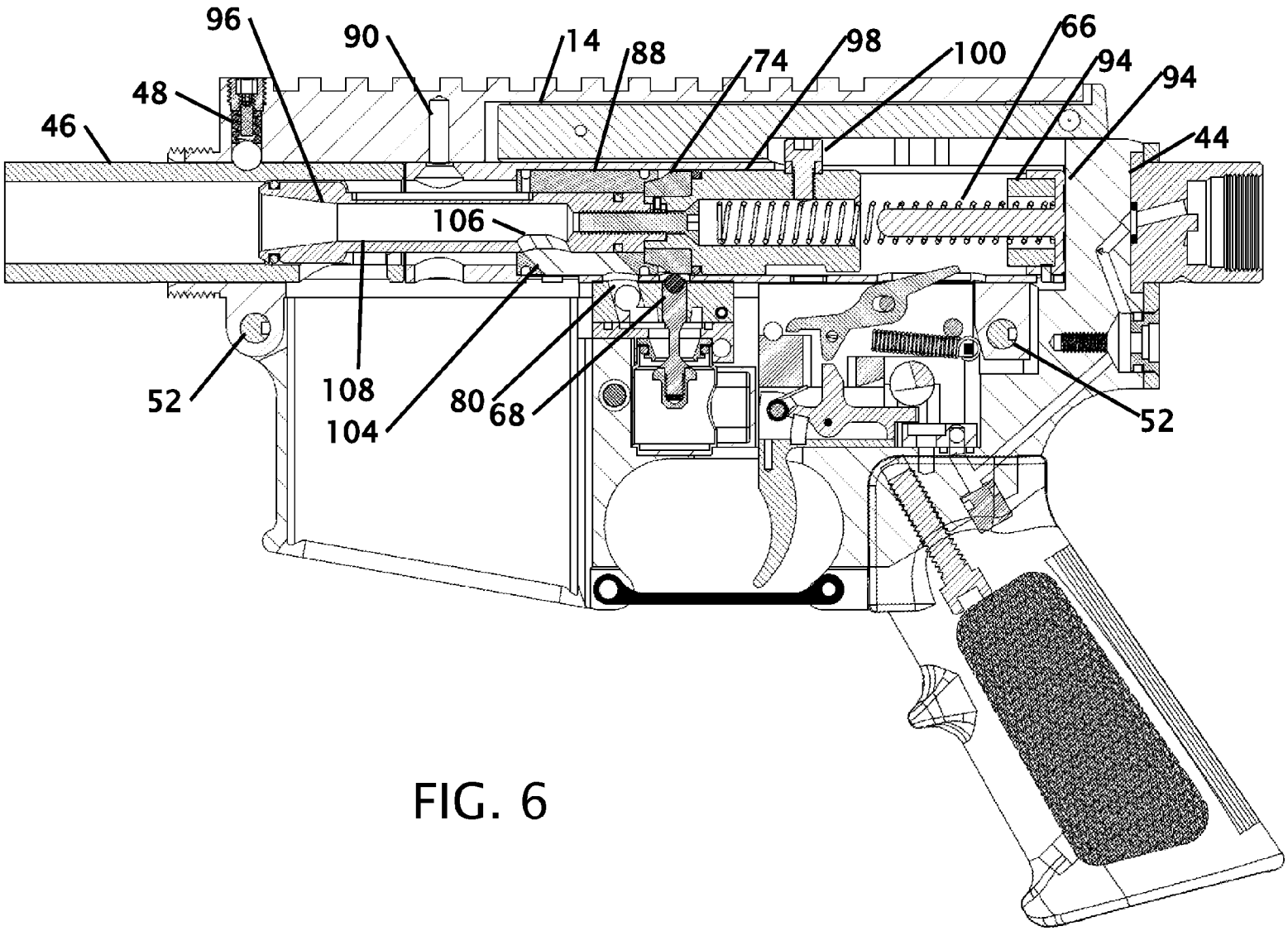
FIG. 6 shows a sectional view of the launcher with the internal components.

Referring to FIGS. 4-6, in selected embodiments, a launcher 10 may comprise an upper receiver 34 and a lower receiver 36. Various internal components may correspond to an upper receiver 34, while other components may correspond to a lower receiver 36. For example, in certain embodiments, a magazine well 38, valve assembly 40, trigger assembly 42, grip 22, and stock mount 44 may correspond to a lower receiver 36, while a barrel 46, barrel detent 48, bolt assembly 50, and charging handle 14 may correspond to an upper receiver 34.

An upper receiver 34 may be separable from a lower receiver 36. For example, one or more pins 52 may secure an upper receiver 34 to a lower receiver 36. Removal of one or more such pins 52 may grant access to a bolt assembly 50, valve assembly 40, trigger assembly 42, or the like. In selected embodiments, the various components of an upper receiver 34 may be secured within the upper receiver 34. Similarly, the various components of a lower receiver 36 may be secured within the lower receiver 36. Accordingly, mere separation of an upper receiver 34 from a lower receiver 36 may not result in such components falling out. In selected embodiments, a trigger assembly 42 may include a trigger 12, sear 54, bolt catch 56, one or more pivots 58, one or more biasing members 60, and one or more stops 62. Pulling the trigger 12 may cause a sear 54 to pivot until it contacts a bolt catch 56. With sufficient pressure, a sear 54 may urge a bolt catch 56 out of engagement with a bolt 64 of a bolt assembly 50. Once a bolt 64 is free of a bolt catch 56, the bolt 64 may move forward as biased by a biasing member 66 acting on the bolt 64. In selected embodiments, a bolt 64 may travel forward to actuate a valve 68 of a valve assembly 40.

Compressed gas (e.g., compressed air, compress carbon dioxide, or the like) may be conducted by one or more conduits 70 to an upstream side of a valve 68 in a suitable manner. In selected embodiments, a launcher 10 may provide or include a platform supporting multiple entry points for compressed gas. For example, in certain embodiments, a lower receiver 36 may include conduits 70 for receiving compressed gas from a butt stock 30 (e.g., via a container or conduit located in the place of a "buffer tube") or a grip 22 (e.g., via a container or conduit located within a grip 22) or a combination thereof. In any given embodiment, entry points that are not to being used may be sealed with an appropriate plug. Thus a user or manufacturer may selected from among various arrangements or configurations with respect to the entry point of compressed gas.

Regardless of the entry point used, compressed gas may be passed by one or more conduits 70 from a reservoir, source, or container of some sort (e.g., 12 or 16 gram canister of carbon dioxide or the like) to an upstream side of a valve assembly 40 (e.g., past a trigger assembly 42 to a space 72 or cavity 72 on an upstream side of the valve assembly 40).

A valve 68 of a valve assembly 40 may be biased toward a closed position by the pressure of gas on the up-stream side of the valve 68, by a biasing member (e.g., by an unknown biasing member within the space 72 or cavity 72), or by some combination thereof. However, after a trigger 12 is pulled and a bolt 64 moves forward, a ramp 74 forming part of the bolt 64 may contact a valve 68 (e.g., a wear element 76 of a valve 68) and force the valve 68 open.

In selected embodiments, a ramp 74 and/or wear element 76 of a valve 68 may be configured to provide a long service life. For example, materials used in the formation of a ramp 74 and/or wear element 76 may be selected to produce little wear on each other. In selected embodiments, one or both of a wear element 76 and a ramp 74 may be formed of a carbide material. Alternatively, or in addition thereto, a ramp 74 may be free to rotate with respect to other components of a bolt 64 (e.g., free to rotate about a central axis of a bolt 64). Accordingly, wear caused by the contact between a ramp 74 and a valve 68 may be distributed over a large area of the ramp 74.

With a valve 68 open, compressed gas may be able to pass from an upstream side of the valve 68 and through one or conduits of a manifold 78 forming a down-stream part of a valve assembly 40. Accordingly, in selected embodiments, a manifold 78 may control how compressed gas is distributed within a launcher 10. For example, in selected embodiments, a manifold 78 may include a first aperture 80 directing a first stream of compressed gas to launch a chambered projectile (not shown) and a second aperture 81 directing a second stream of compressed gas to an aperture 82 feeding a particular space 84 within a bolt assembly 50. Compressed gas within this particular space 84 may slow the forward motion of a bolt 64, stop the forward motion of the bolt 64, produce a rearward motion of the both 64, return a bolt 64 to a cocked position (e.g., where a bolt catch 56 has once again engaged a bolt 64), or some combination thereof.

In selected embodiments, a bolt assembly 50 may include a bolt sleeve 86, separator 88, end cap 92, buffer 94, bolt 64, or the like or a combination or sub-combination thereof. A bolt sleeve 86 may provide an interface between a bolt 64 and an upper receiver 34. In certain embodiments, a bolt sleeve 86 may include apertures permitting a valve 68, compressed gas, bolt catch 56, to enter a bolt assembly 50. A bolt sleeve 86 may have an interior surface against which various other components of a bolt assembly 50 may seal. In certain embodiments, a bolt sleeve 86 may be selectively removable. Accordingly, one or more fasteners 90 (e.g., threaded fasteners) may secure a bolt sleeve 86 within an upper receiver 34.

In selected embodiments, a separator 88 may separate compressed gas for launching a projectile from compressed gas for returning a bolt 64 to a cocked position. In selected embodiments, a bolt 64 may pass through a central aperture of a separator 88. Additionally, a separator 88 may include an aperture 104 aligned to receive compressed gas from a first aperture 80 of a manifold 78. Accordingly, once a valve 68 is actuated, this aperture 104 of a separator 88 may align with an aperture 106 in a forward portion 96 of a bolt 64, thereby enabling compressed gas to pass forward through a central (e.g., axial) aperture 108 in the forward portion 96 and propel a projectile out the barrel 46.

An end cap 92 may fit within a bolt sleeve 86 and provide an interface between a bolt assembly 50 and a stock mount 44 of a lower receiver 36. A stock mount 44 may be sized, shaped, and contain sufficient material (e.g., be substantially solid material as opposed to the ring of material found in an actual AR15 type rifle) to properly and repeatedly resolve the loads imposed thereon by a bolt assembly 50. In selected embodiments, an end cap 92 may include a center extension for supporting and aligning a biasing member 66 acting on a bolt 64. Alternatively, or in addition thereto, an end cap 92 may house, support, or locate a buffer 94. A buffer 94 may cushion an impact between a returning bolt 64 and an end cap 92.

A bolt 64 may include a forward portion 96, rearward portion 98, ramp 74, extension 100, or the like or a combination or sub-combination thereof. A rearward portion 98 may interface with a biasing member 66 urging the bolt 64 forward. For example, in selected embodiments, a rearward portion 98 may include an aperture for receiving such a biasing member 66. As a bolt moves forward, a forward portion 96 may push a projectile off the top of a magazine 26 and into a chamber location of a barrel 46. In a forward position, a forward portion 96 may also form a bridge for conducting compressed gas past one or more openings (e.g., a port 110 in a barrel through which projectiles pass) that would otherwise permit compressed gas to escape.

In selected embodiments, an extension 100 of a bolt 64 may extend through a corresponding slot 102 in a bolt sleeve 86. According, as a charging handle 14 is pulled rearward, it may engage an extension 100 and pull a bolt 64 rearward. This rearward motion may continue until a bolt catch 56 engages an appropriate edge, lip, or surface of a bolt 64 (e.g., of a rearward portion 98). In this manner, certain embodiments of a launcher 10 in accordance with the present invention may be manually cocked.

A bolt assembly 50 may include various seals as desired or necessary. For example, one or more seals may interface between a forward portion 96 and a barrel 46, a separator 88 and a bolt sleeve 86 (grooves for seals are show in separator 88, by the seals are not shown), a separator and a forward portion 96, a rearward portion and a bolt sleeve 86, or the like or a combination or sub-combination thereof.

In selected embodiments, a barrel 46 may include a projectile retainer 112. A projectile retainer 112 may hold a projectile in a desired location, ready to be pushed forward into a chamber of the barrel 46. In certain embodiments, a projectile retainer 112 may deflect or pivot out of the way as a forward portion 96 of a bolt 64 chambers a projectile.

A launcher 10 in accordance with the present invention may be modular and easily converted between various configurations. For example, in selected embodiments, an upper and lower receivers 34, 36 may form a platform into which various modules or sub-assemblies may be easily swapped in and out. This swapping in and out may be accomplished with simple motions like threading fasteners and pushing or pulling pins and without any machining, welding, bonding, or other permanent changes.

For example, in selected embodiments, a lower receiver 36 and the components corresponding thereto may be left unchanged, while a barrel 46 and all or some portion of a bolt assembly 50 is replaced in an upper receiver 34.

Alternatively, if desired or necessary, a new manifold 78 or the like may be swapped into a lower receiver 36 to properly interface with a new bolt assembly 50 or some portion thereof that have been swapped into an upper receiver 34.

Such a change to the barrel 46, bolt assembly 50, manifold 78, or the like may enable a newly configured launcher 10 to propel a different kind of projectile. For example, in one configuration, a launcher 10 may be configured to fire paintballs, while in another configuration, a launcher 10 may be configured to fire BBs (e.g., metal BB's, airsoft BBs, or the like) or some other projectile. Thus, components (e.g., valve assemblies 40 or selected portions thereof, trigger assemblies 42 or selected portions thereof, bolts 64 or selected portions thereof, bolt sleeves 86, barrels 46, or the like) may be swapped in and out of a platform in accordance with the present invention to produce a launcher 10 for anyone of a wide range of projectiles, while preserving the look and feel and external characteristics of the launcher 10.

In selected embodiments, a valve assembly 40 or some portion thereof (e.g., a manifold 78 may extend forward into a portion of a magazine well 38. This may enable a valve assembly 40 to receive compressed gas from a magazine 26. Alternatively, this may enable a valve assembly 40 to direct compressed air into a magazine 26. This compressed gas may then be used within a magazine to aid in some function such as urging projectiles or the like. In selected embodiments, compressed gas delivered to a magazine 26 may be stored in the form of advancing a piston or the like against a biasing member. In this manner energy from the compressed gas associated with multiple firing events may be collected and used as desired.

Figure 7:
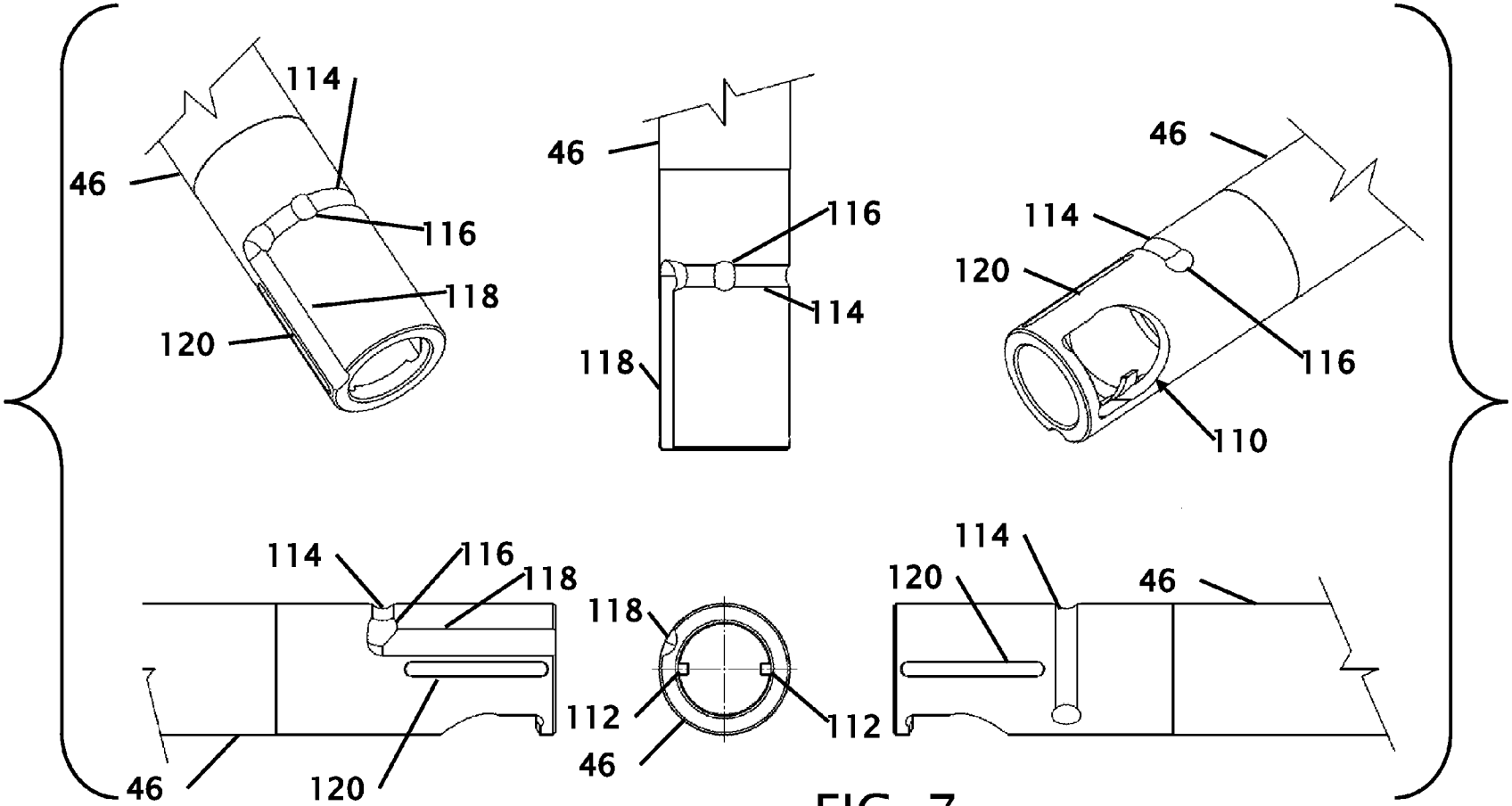
FIG. 7 shows various views of the barrel of the launcher.
Figure 8:
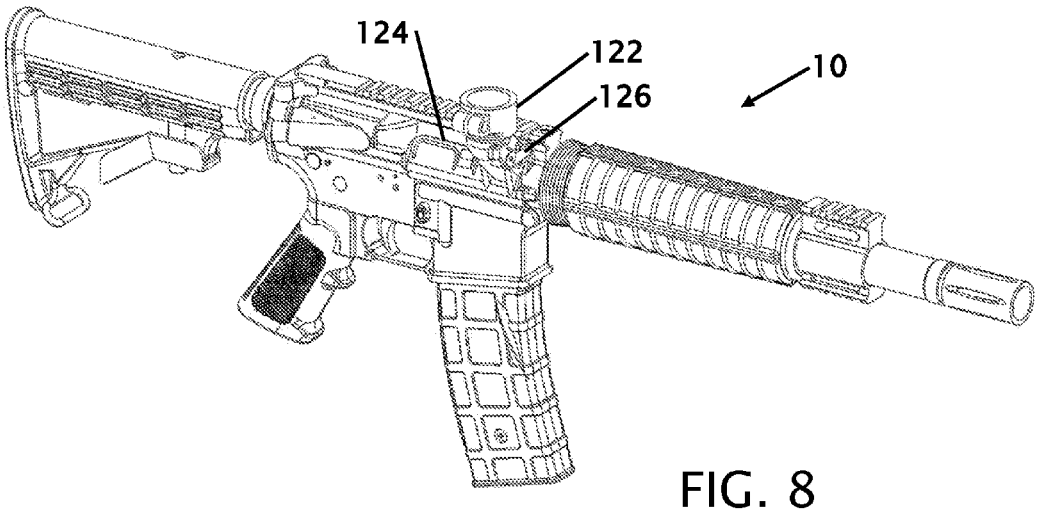
FIG. 8 shows a side perspective view of the launcher with a top feed adapter.
Figure 9:
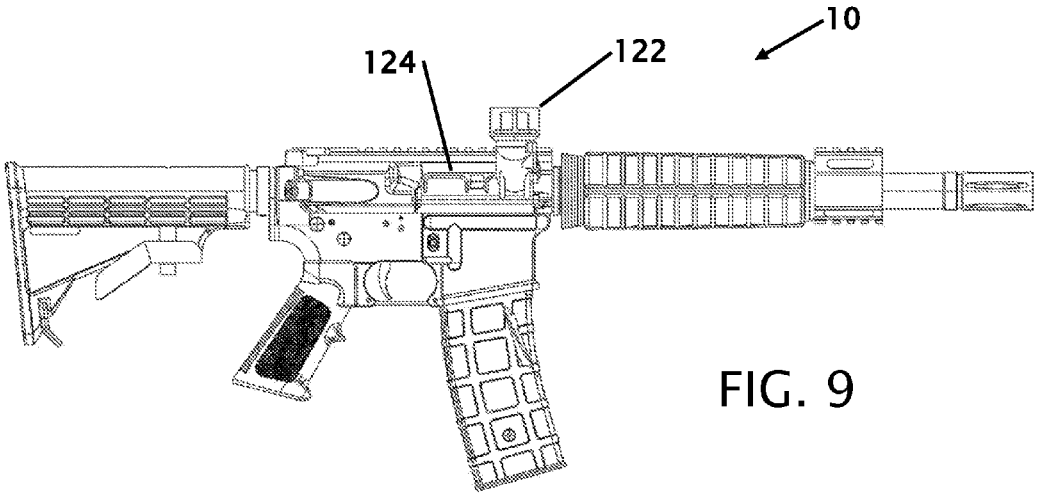
FIG. 9 shows a side view of the launcher with the top fee adapter.
Figure 10:
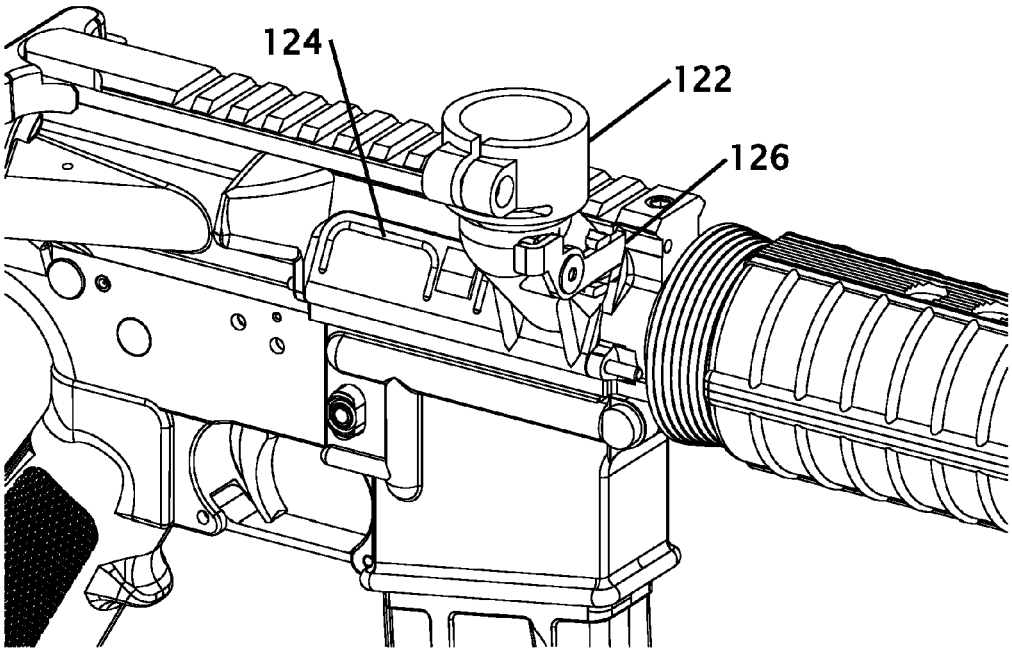
FIG. 10 shows a perspective view of the top feed adapter.
Figure 11:
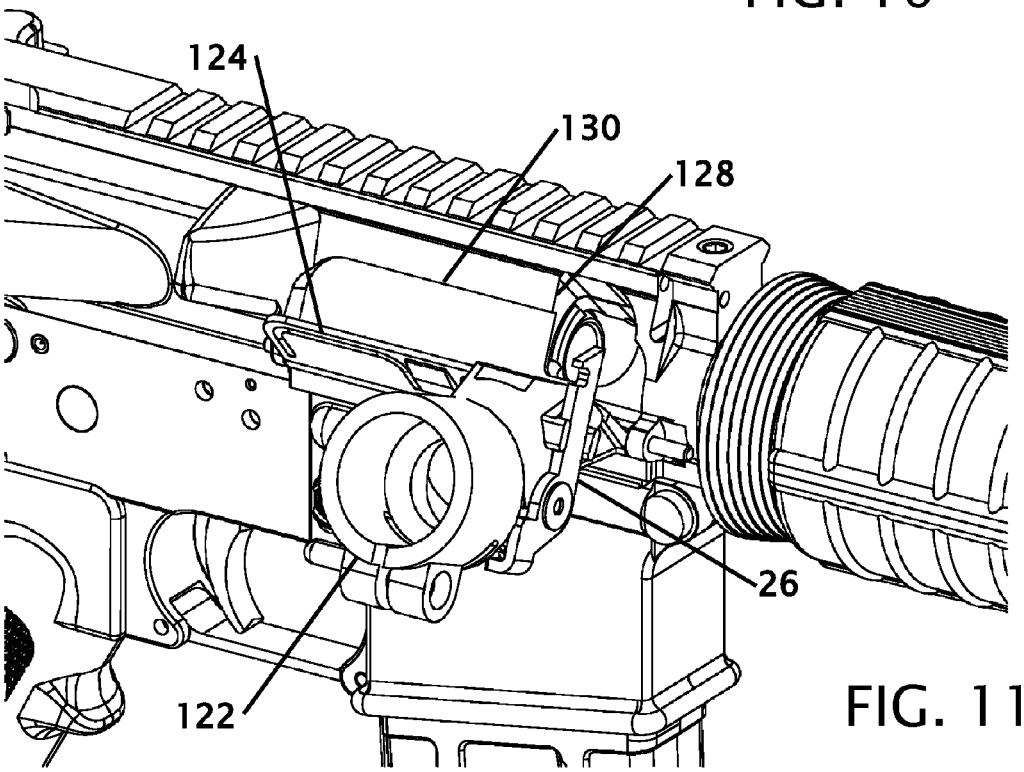
FIG. 11 shows a perspective view of the top feed adapter with the top feed adapter hinged open.
Figure 14:
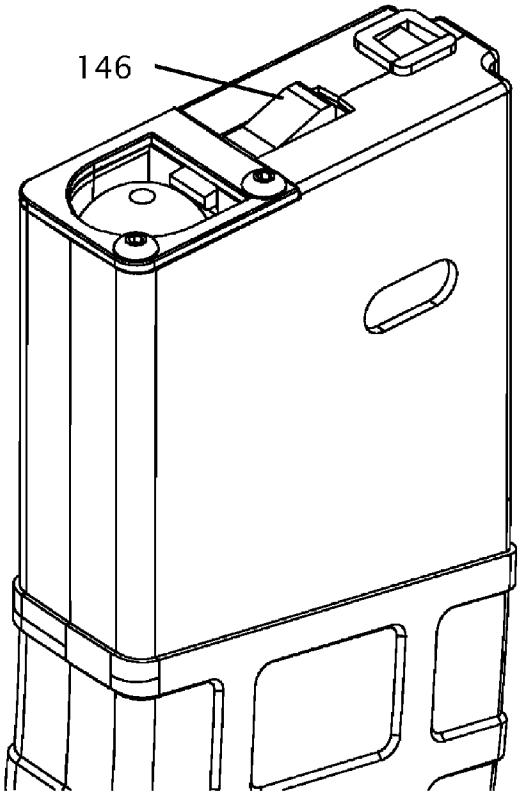
FIG. 14 shows a top perspective view of view of the magazine.
Figure 13:
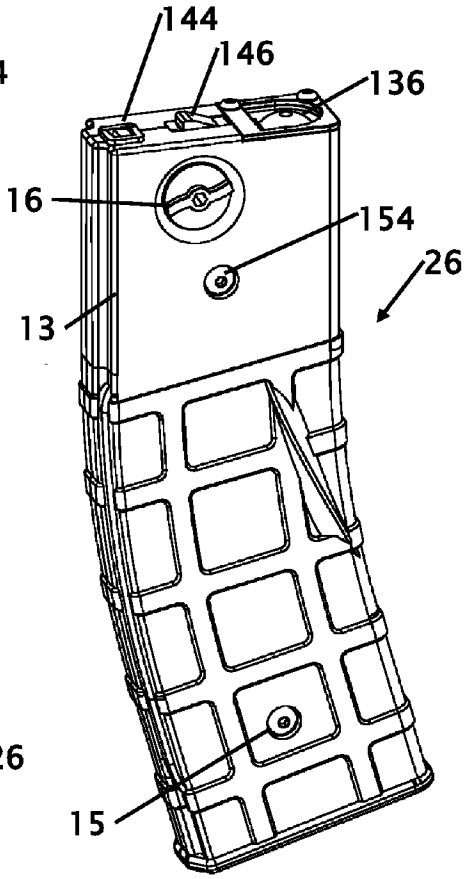
FIG. 13 shows a perspective view of the magazine.
Figure 12:
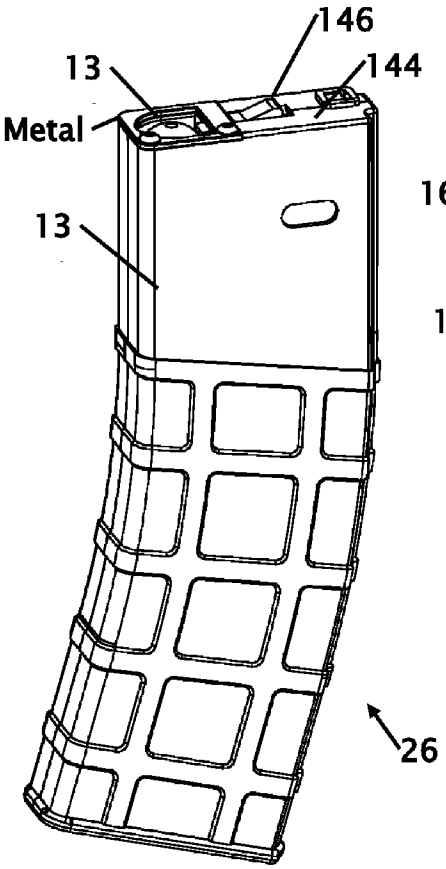
FIG. 12 shows a perspective view of the magazine.
Figure 16:
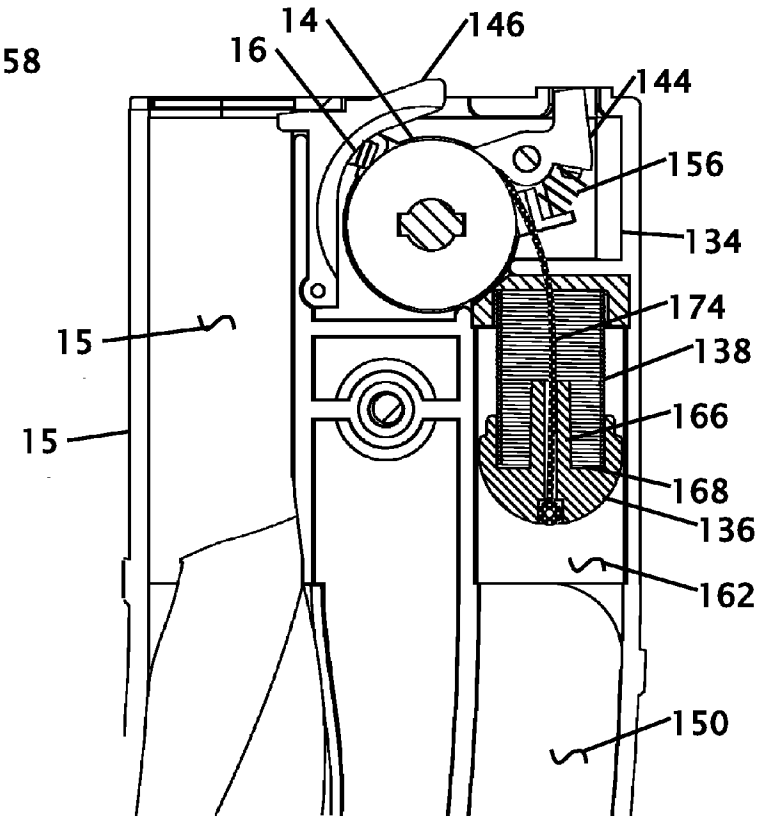
FIG. 16 shows a plan view of one side of the magazine showing the internal structure.
Figure 15:
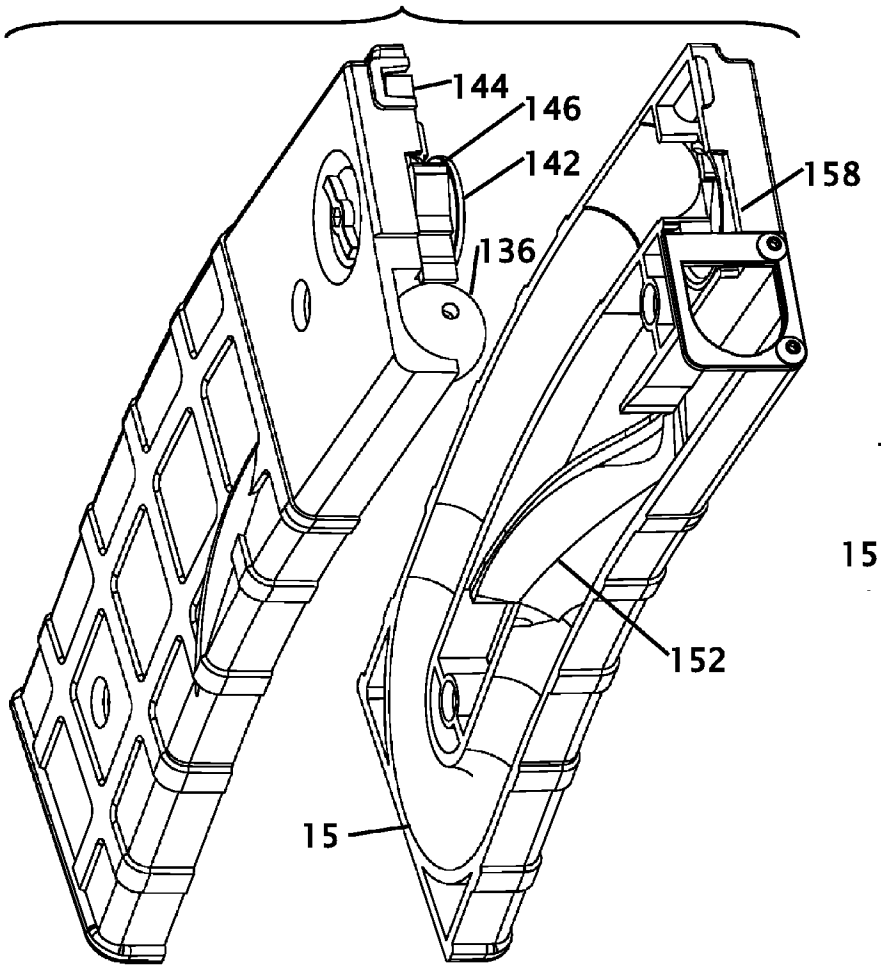
FIG. 15 shows a perspective view of the magazine in a partially exploded view.
Figure 19:
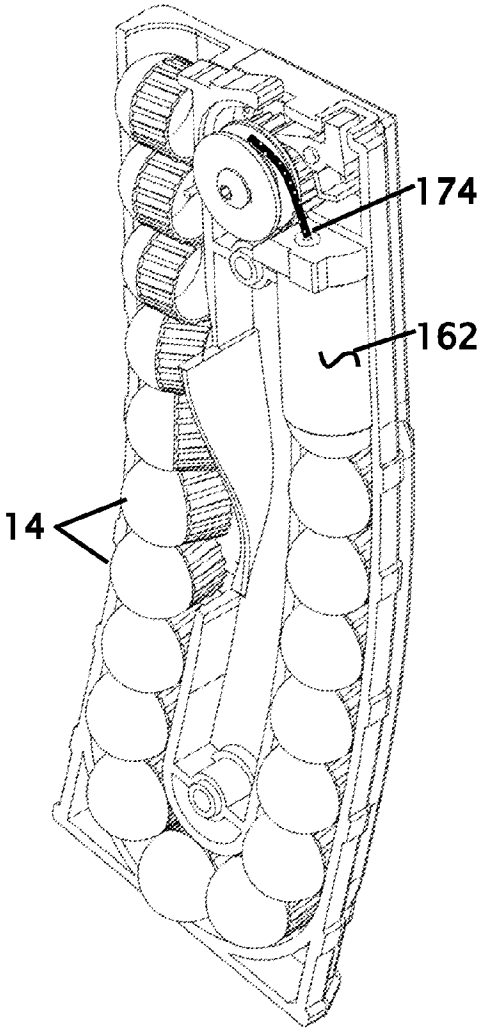
FIG. 19 shows a perspective view of half of the magazine loaded with projectiles.
Figure 18:
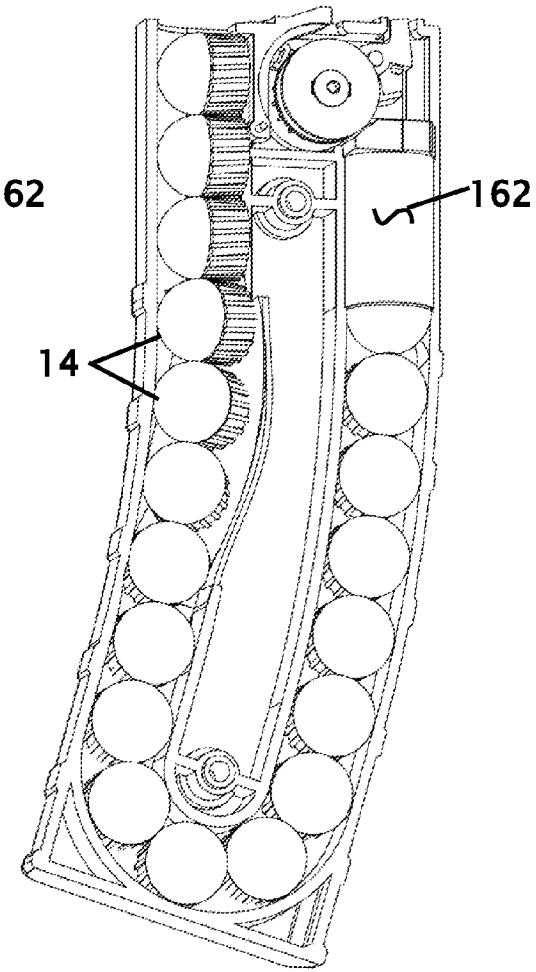
FIG. 18 shows a perspective view of half of the magazine loaded with projectiles.
Figure 17:
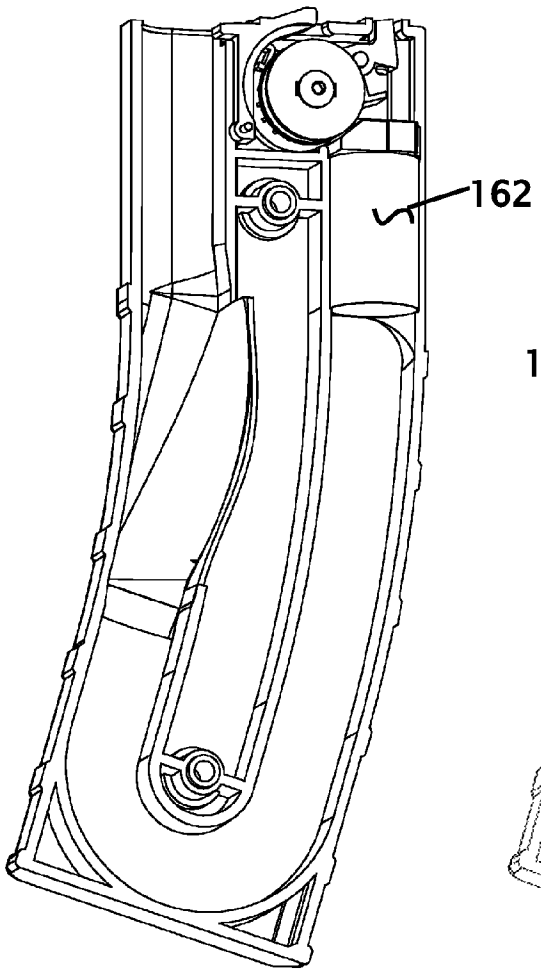
FIG. 17 shows a perspective view of half of the magazine.
Figure 20:
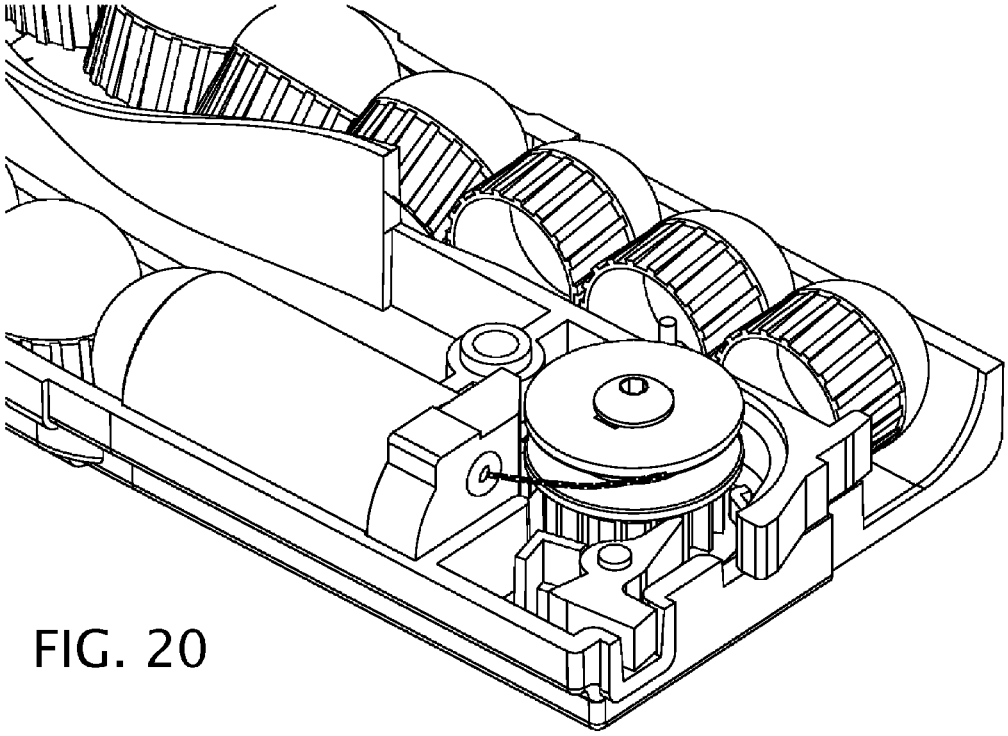
FIG. 20 shows a detail perspective view of half the magazine loaded with projectiles.
Figure 21:
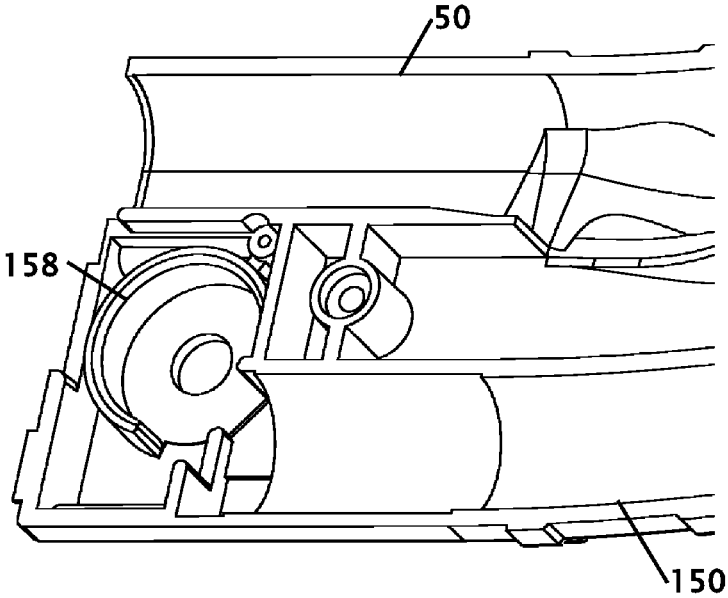
FIG. 21 shows a perspective view of an empty magazine with the channel for the projectiles.
Figure 22:
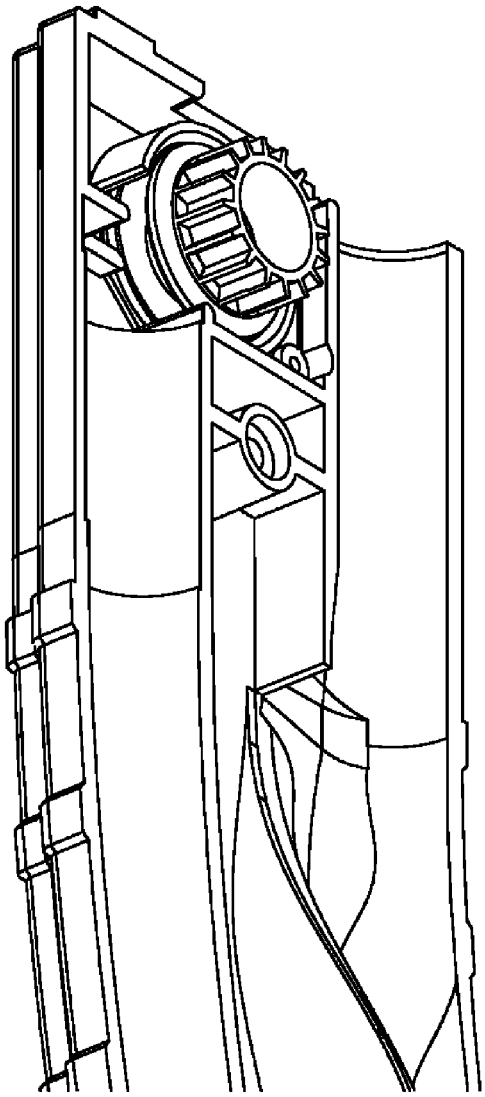
FIG. 22 shows a perspective view of an empty magazine with the channel for the projectiles.
Figure 23:
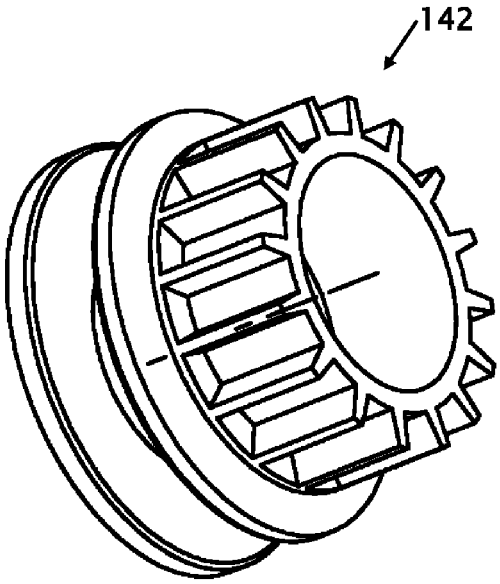
FIG. 23 shows the spool from the magazine.

Referring to FIGS. 5-7, in selected embodiments, a barrel 46 and barrel detent 48 may combine to provide significant flexibility and speed in adapting a barrel 46 to differing configurations. For example, in selected embodiments, it may be desirable to feed projectiles from a magazine 26. Accordingly, a port 110 in a barrel 46 may be positioned to open to the magazine 26. However, in other embodiments, it may be desirable to feed projectiles from a top mounted hopper. Accordingly, a barrel 46 may need to be rotated (e.g., about a central axis) to position a port 110 to receive a top feed of projectiles.

To accomplish this, in selected embodiments, a barrel 46 may include a circumferential groove 114. A barrel detent 48 may extend into this groove 114. Accordingly, an engagement between a barrel detent 48 and a circumferential groove 114 may axially secure a barrel 46 within an upper receiver 34. However, when a user desires to change a position of a port 110, the user may simply grasp the barrel 46 and rotate it until the port 110 is in the desired position. A fore grip 24 and certain other forward components (e.g., forward components, rails, or the like corresponding to a simulated or mock gas block), may secure directly to an upper receiver 34 and may be "free float" a barrel 46.

Accordingly, a barrel 46 may rotate within the fore grip 24 and those forward components without the fore grip 24 and those forward components moving or being loosened from an upper receiver 34.

In selected embodiments, a circumferential groove 114 may include one or 5 more resting locations 116. A resting location 116 may be an enlargement in the circumferential groove 114. Accordingly, when it encounters a resting location 116, a barrel detent 48 may engage more deeply and noticeably to the user. Resting locations 116 may correspond to desired positions of rotation of the barrel 46. For example, a first resting location 116 may correspond to a proper alignment of a port 110 with a magazine 26, while a second resting location may correspond to a proper alignment of a port 110 with a top feed hopper.

In certain embodiments, a mere detent engagement between a barrel detent 48 and a circumferential groove 114 (e.g., a resting location 116 in a circumferential groove 114) may be all the engagement necessary. In other embodiments, tightening a barrel detent 48 (e.g., threading a portion of a barrel detent 48 down onto a detent ball or the like) may effectively lock the barrel 46 in a desire location (e.g., resting location 116).

In selected embodiments, a barrel 46 may include an axial groove 118. An axial groove 118 may provide a mechanism for the easy removal of a barrel 46. For example, once a barrel 46 has been rotated with respect to an upper receiver 34 to the point where a barrel detent 46 is aligned with an axial groove 118 (e.g., enters a resting location 116 formed at the junction of a circumferential groove 114 and an axial groove 118), the user may pull the barrel 46 away from the upper receiver 34 in the axial direction. This may make the barrel detent 48 enter the axial groove 118 and the barrel 46 may be pulled free of the upper receiver 34 (and free of the fore grip 24 and certain forward components mounted to the upper receiver 34). To install a barrel 46, this process may be reversed.

A barrel 46 may include various apertures 120 as desired or necessary. For example, in selected embodiments, a barrel 46 may include one or more apertures 120 (e.g., opposing apertures 120) for housing projectile retainers 112.

Referring to FIGS. 8-11, in selected embodiments, a launcher 10 in accordance with the present invention may include a feed tube 122. A feed tube 122 may enable projectiles to flow down into a launcher 10 (e.g., from a hopper supported by or connected to the feed tube 122). In certain embodiments, a feed tube 122 may be mounted on a "dust cover" 124.

Antifouling Shroud

An integrated molded-in circular shroud is formed when the two halves of the magazine are placed together, this shroud encapsulates approximately 75% of the reel, leaving only an opening toward the feeding hole. The magazine "reel" always performs an expected "over stroke" when the magazine, under spring tension, is actuated.

In an AR-15 type rifle, a dust cover 124 may cover an ejection port to prevent unwanted materials from entering the action while the firearm is not in use. In selected embodiments in accordance with the present invention, a feed tube may be included as part of a dust cover 122 (e.g., a mock or a functional dust cover) to pivot therewith. This pivoting and a corresponding latch 126 may support inspection, cleaning, or the like. Additionally, the pivot points of a dust cover 124 may provide connection points enable a dust cover 124 without a feed tube 122 to be swapped for a dust cover 124 with a feed tube 122. Thus, the aesthetic integrity of the launcher 10 may be preserved as much as possible.

In certain embodiments, an aperture 128 for admitting a larger projectile (e.g., a paintball) may be bigger than an ejection port (e.g. mock ejection port 130) typically associated with AR-15 type rifles. In such embodiments, a dust cover 124 without a feed tube 122 may extend up to cover that larger aperture 138. Thus, in selected embodiments, a dust cover 124 may be functional as a cover.

Internal Mainspring Retention Sleeve 162

The purpose of this sleeve 162 is so the user can easily open the magazine and clean the channels as needed without having the spring 138 be in their way. Prior to opening the magazine, the user completely winds the magazine all the way back to the stopped position. They then open the magazine and can see that the follower 136 and spring 138 are completely retained within the sleeve 162. This is also a great benefit for reassembling the magazine so that the user does not have to have difficulty manipulating the sleeve 162 into the proper channels when closing the two halves together.

Referring to FIG. 12-23, in selected embodiments, a magazine 26 may include a housing 132, follower assembly 134, and keeper 146. A housing 132 may be have the exterior size and shape of a convention AR-15 magazine 26. Internally, a housing 132 may define a channel 150 for housing and feed projectiles 148. A housing may have two halves. In selected embodiments, the various internal components of a magazine may be secured to one half or the other. Accordingly, when one or more fasteners 154 are removed and the two halves are separate, not internal components will fall out.

Non-Wearing Cord Bushing

The "pilot" 174 that the cord goes through made of a material other than polymer. This ensures that no erosion takes place while the cord is under stress and in motion.

Helical Transition

A geometrical arrangement incorporated into both molded sides of the magazine. This arrangement is made for the sole purpose of reorienting projectile 14 into the magazine so that the magazine is able to attain its maximum volume capacity. This helical transition has no effect on the feeding of regular spherical projectiles. It should be noted that this helical transition was made to intentionally take place on the forward, concave portion of the magazine thereby reorienting the projectiles 14 so that the "skirts" are separated and that the "round nose" portions only make contact with one another to assure the maximum bearing situation for proper rotation, reorientation and flow.

In selected embodiments, a channel 150 may include a contoured surface 152 to change an orientation of projectiles 148 as they pass thereby. Accordingly, a magazine may be suitable for use with non-spherical projectiles. For example, a magazine 26 may be suitable for use with FIRST STRIKE (registered trademark) projectiles. In selected embodiments, a channel 150 may house about 18-20 paintball projectiles 148.

A biasing member 138 may be positioned within a channel 150 and extend to urge a follower against the projectiles 148. In a retracted position, a biasing member 138 may be drawing into a sleeve 162. In an extended position, a biasing member 138 may extend about the length of the channel 150. Thus, a biasing member 138 may provide a motive force urging projectiles 148 out of the channel 150 and magazine 26.

Dual-Purpose Ball Retention System

This system uses a keeper 146 to assist in retaining projectiles in magazine while said magazine is outside of magazine well. Since retainer is spring-loaded against underside of upper receiver internals, upon magazine ejection, the magazine is urged downward "aiding" magazine ejection A flexible tether 174 (e.g., string, cord, cable) may extend from a follower 136 and wrap around a spool 142. A lock 144 may selectively engage the spool 142. When the lock 144 engages the spool 144, no tether 174 may be released and the biasing member 138 may not advance within a channel 150. Conversely, when the lock 144 releases the spool 144, the spool 144 may turn and release tether 174, which may free a follower 136 to move through a channel 150 pushing the projectiles 148.

A lock 144 may be actuated by a corresponding portion of a launcher 10 (e.g., an extension on a bolt sleeve 86). Thus, when the magazine 26 is fully seated and secured in the magazine well 38, the lock 144 may be pushed against the bias of a biasing member 156 and pivot out of engagement with one or more teeth extending from the side of a spool 142, which may then be free to turn. Conversely, when the magazine 26 is released from the magazine well 38, the lock 144 may act as biased and engage the teeth extending from the side of the spool 142 to prevent further rotation thereof. Thus, when a magazine 26 is released from a magazine well 38, a follower 136 may be prevented from pushing any more projectiles 148 out of the magazine 26.

In selected embodiments, a spool 144 may be encircled by a barrier 158 or wall 158. Accordingly, the barrier 158 may prevent the tether 174 from slipping out of the spool 142 and causing a jam or malfunction.

Available Hex Key Location on Crank for Easy Winding

The crank 164 provides a more robust and reliable magazine system for both round and aerodynamic projectiles. The incorporation of these features ads to an extended life of all internal components and function, easier serviceability and handling, improved feeding characteristics.

In selected embodiments, a keeper 146 may prevent projectiles 148 from falling out of a magazine 26 when the magazine is out of the magazine well 38. A keeper 146 may pivot against a bias of a biasing member 160. Thus, when the magazine is fully seated and secured in the magazine well 38, the keeper 146 may be pushed against the biasing of a bias member 160 and pivot out of the channel 150, which may then free projectiles 148 to exit the magazine 26.

Conversely, when the magazine 26 is released form the magazine well 38, the keeper 146 may act as biased and pivot back into the channel 150 to prevent additional projectiles 148 from exiting the magazine 26. In selected embodiments, the biasing member 160 acting in a magazine 26 may provide an aid in urging the magazine 26 out of a magazine well 38. Accordingly, once a magazine release 16 has been actuated, a biasing member 160 may urge a keeper 146 out and cause to the magazine 26 to move or pop somewhat out of the magazine well 38.

A spool 142 may be turned by an exterior crank 164. A crank 164 may be turned by hand or using a tool (e.g., an HEX wrench or the like). Turning a crank 164 may turn a spool 142 and wind the tether 174 back around the spool 142, thereby compressing the biasing member 138 and pulling the follower 136 back to a starting position. In selected embodiments, a magazine 26 may include a sleeve 162. A sleeve 162 may house a biasing member 138 when it is fully retracted.

A follower 136 may have a "tail" 166 to which a tether 174 may secure or from which a tether 174 may extend. The tail 166 may be somewhat elongated to help the follower 136 track in a proper orientation through a channel 150. In selected embodiments, a follower 136 may include a recessed pocket 168 for receiving a biasing member 138. This pocket 168 may allow for a more compact design supporting more projectiles 148 within a magazine 26.

Figure 24:
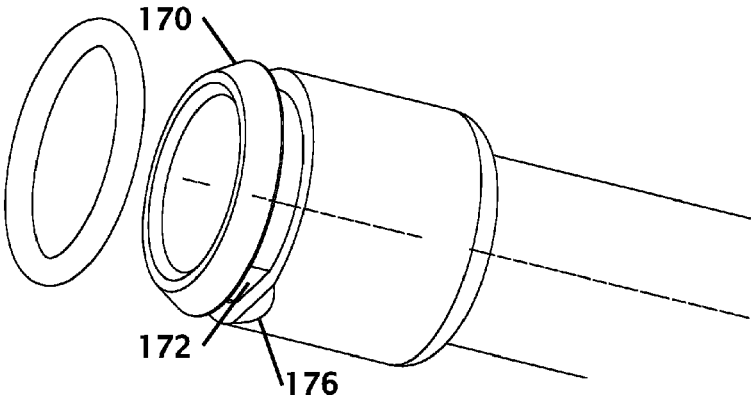
FIG. 24 shows a perspective view of the forward portion of the barrel.
Figure 25:
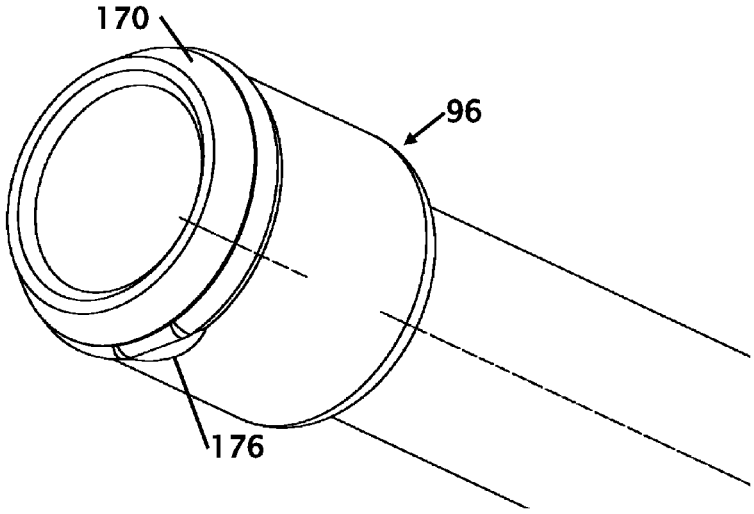
FIG. 25 shows a perspective view of the forward portion of the barrel.

Referring to FIGS. 24-26, in selected embodiments, a forward portion 96 may include a beveled edge 170 that may assist the forward portion in engaging, positioning, pushing, and/or delivering compressed gas to certain projectiles (e.g., FIRST STRIKE projectiles). Alternatively, or in addition thereto, a forward portion 96 may have a flat 172 formed therein or thereon. In selected embodiments, the flat 172 may be positioned within a seal groove. Accordingly, when a seal is placed in the seal groove, the seal may extend less from a forward portion 96. In certain embodiments, a seal groove may also have a bevel 176 formed thereon. A seal that extends less and/or a bevel 176 formed on an edge of a seal groove may be positioned on the bottom of a forward portion 96 and help to prevent a forward portion 96 from snagging on a projectile 148 (e.g., the skirt of a projectile 148) in the "on deck position" (e.g., next in line to be chambered) as the forward portion 96 move forward.

Referring to FIGS. 27-29, in selected embodiments, a trigger assembly 42 may support semiautomatic fire, fully automatic fire, a safety, or a combination or sub-combination thereof. For example, a selector switch 32 may control the pivoting of a trigger 12, sear 54, or both. Accordingly, in certain embodiments, in a safe mode, a selector switch 32 may block pivoting of a trigger 12. In a semiautomatic fire, a selector switch 32 may leave a trigger 12 free to pivot and a sear 54 free to pivot with respect to the trigger 12. In a fully automatic mode, a selector switch 32 may leave a trigger 12 free to pivot and block certain pivoting (and resetting) of a sear 54. Thus, by controlling a trigger 12 and/or sear 54, a selector switch 32 may control the motion of a catch 56 and set the mode of firing.

In certain embodiments, a trigger assembly 42 may provide a mechanical fully automatic fire, selectable with a selector switch 32. This may be accomplished in any suitable manner. In selected embodiments, it may be accomplished hydraulically, wherein a damper is used to slow the motion of certain components of a trigger assembly 42 (e.g., a bolt catch 56). This may enable a trigger assembly 42 to operate at a slower rate (e.g., 8-20 cycles per second) to a firing rate that can accommodate certain types of projectiles (e.g., paintballs).

In illustrated embodiment shown in cross section, a hydraulic damper 178 may slow forward of motion of a catch 56, without slowing rearward motion of the catch 56. A damper 178 may include a first cavity 182, a second cavity 184, and a check valve 180 position in a fluid path between the first and second cavities 182, 184. As a catch 56 moves forward and back within its slot 186, one or more pistons 188 may move within a first cavity 182, changing the volume thereof. For example, as a catch 56 moves forward, pistons 188 may lower the volume of the first cavity 182 and push hydraulic fluid out of the first cavity 182, against a check valve 180 and into the second cavity 184. Due to the restriction caused by the check valve 180, this may be a relatively slow process.

Conversely, as a catch 56 moves rearward, pistons 188 may increase the volume of the first cavity 182 and draw hydraulic fluid out of the second cavity 182, through the check valve 180 and into the first cavity 184. Due to the opening of the check valve 180, this may be a fast process.

FIG. 30 shows an outer view of the full auto hydraulic module FIG. 31 shows the center section of the full auto hydraulic module and FIG. 32 shows the end stroke preload dampers sectional view full auto hydraulic module. The hydraulic module is removable from the frame by removing two pins through holes 301. Spring 302 keeps the bolt catch 56 or sear 54 pulling to the rear of the biasing member 156. A clevis 303 is connected to a pin 304 that is then connected to a hydraulic damper 305 that allows slow forward motion, but fast rearward motion to allow for a rapid reset so it can fire fully automatic in a controlled manner. When the selector 32 is placed in this semi-automatic position, the end of the sear 54 is prevented from full movement by a shelf 310 in the selector 32. This allows the angled top 320 of the sear 54 to move along the bottom 321 of the bolt catch 56. This allows a firing rate of 9 to 16 rounds per second, but this rate can be adjusted. Over time, seals on the piston 305 can have an increased static coefficient of friction.

Because of the increased static coefficient of friction, an end-stroke preload device when the unit is cocked, a spring loaded pin 330 (located on both sides of the unit) prevents the increased static friction by assisting the return spring. The sum of the spring force on the spring loaded pin 330 and the spring 302 must be less than the force of the return spring. This makes the biasing member of the catch 56 moves within a portion of the slot 340.

Thus, specific embodiments of a pneumatic launcher system and method has been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A pneumatic launcher system comprising:

a launcher frame;

said launcher frame including an interchangeable trigger module;

said interchangeable trigger module provides handling different projectile types;

said interchangeable trigger module provides different firing modes and rates;

said interchangeable trigger module includes a trigger, a firing rate selector, a catch, a hydraulic damper and at least one piston;

said launcher frame including an interchangeable bolt, and said interchangeable bolt provides for launching different projectile types;

said launcher frame including an interchangeable barrel, and said interchangeable barrel provides for launching different projectile types.

2. The pneumatic launcher system according to claim 1 wherein said launcher frame is configurable to receive projectiles from a magazine, top mounted hopper and top feed.

3. The pneumatic launcher system according to claim 2 wherein said interchangeable barrel includes a circumferential groove and a barrel detent and an axial groove to allow said interchangeable barrel to be rotated to orient a port in said interchangeable barrel to load projectiles and removed.

4. The pneumatic launcher system according to claim 1 wherein said interchangeable trigger module includes operation modes of individual pneumatic projectiles, a burst of successive pneumatic projectiles in rapid fire of pneumatic projectiles.

5. The pneumatic launcher system according to claim 4 wherein said rate of both said burst of successive pneumatic projectiles and said rapid fire of pneumatic projectiles is adjustable by adjusting said hydraulic damper.

6. The pneumatic launcher system according to claim 1 wherein said pneumatic projectiles are paintballs, pellets, metal BBs and airsoft BBs.

7. The pneumatic launcher system according to claim 1 that further includes a hopper elbow that hinges from said launcher frame.

8. The pneumatic launcher system according to claim 1 wherein said launcher frame remains pressurized while said bolt, said barrel and said trigger module is interchanged.

9. The pneumatic launcher system according to claim 1 wherein said hydraulic damper slows motion of said catch in only a first direction of travel.

10. The pneumatic launcher system according to claim 9 movement of said catch in a second direction that is opposite of said first direction moves said at least one piston in said first cavity to increase a volume.

11. The pneumatic launcher system according to claim 9 further includes a clevis connected to a pin that is connected to said hydraulic damper.

12. The pneumatic launcher system according to claim 11 wherein said clevis moves in a slot.

13. The pneumatic launcher system according to claim 12 wherein said pin is spring loaded.

14. The pneumatic launcher system according to claim 13 wherein said spring loaded pin prevents increased static friction by assisting said spring.

15. The pneumatic launcher system according to claim 14 wherein said clevis is connected to said catch.

16. The pneumatic launcher system according to claim 1 wherein said damper includes a first cavity, a second cavity, and a check valve 180 position in a fluid path between said first cavity and said second cavities.

17. The pneumatic launcher system according to claim 16 wherein movement of said catch moves said at least one piston in said first cavity to decrease a volume.

18. The pneumatic launcher system according to claim 17 further includes a check valve.

19. The pneumatic launcher system according to claim 1 wherein said hydraulic damper is removable as a module from said launcher frame.

20. The pneumatic launcher system according to claim 19 further includes a spring that keeps said catch pulling to a rear of a biasing member.

* * * * *